US007773905B2

(12) United States Patent
Kuruma

(10) Patent No.: US 7,773,905 B2
(45) Date of Patent: Aug. 10, 2010

(54) ELECTROPHOTOGRAPHIC COLOR IMAGE FORMING APPARATUS

(75) Inventor: Tomoya Kuruma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 473 days.

(21) Appl. No.: 11/854,216

(22) Filed: Sep. 12, 2007

(65) Prior Publication Data

US 2008/0279579 A1 Nov. 13, 2008

(30) Foreign Application Priority Data

May 7, 2007 (JP) ..... 2007-122493

(51) Int. Cl.
*G03G 15/00* (2006.01)
*G03G 21/18* (2006.01)

(52) U.S. Cl. ..... 399/90; 399/111; 399/112

(58) Field of Classification Search ..... 399/90, 399/112

See application file for complete search history.

(56) References Cited

U.S. PATENT DOCUMENTS 6,922,536 B2 * 7/2005 Arimitsu et al. ..... 399/90
7,092,657 B2 8/2006 Nakashima et al. ..... 399/111
2004/0009004 A1 * 1/2004 Mizoguchi ..... 399/90
2007/0071482 A1 * 3/2007 Okabe ..... 399/90

* cited by examiner

*Primary Examiner*—David P Porta
*Assistant Examiner*—Bryan P Ready
(74) *Attorney, Agent, or Firm*—Fitzpatrick, Cella, Harper & Scinto

(57) ABSTRACT

A color electrophotographic image forming apparatus includes a movable member supporting a plurality of process cartridges in juxtaposition and movable between positions inside and outside a main assembly in a direction crossing a longitudinal direction of a drum of the cartridge when cartridges are supported, a common electroconductive member extended on the movable member in the movement direction thereof and being provided adjacent to longitudinal ends of the supported cartridges, an electrical contact provided on the movable member, connected with the common electroconductive member, and electrically connectable with a cartridge electrical contact provided on each of the cartridges, and a main assembly electrical contact electrically connectable with the common electroconductive member to supply electric power to the common electroconductive member and each of the cartridges from the main assembly.

9 Claims, 20 Drawing Sheets

ELECTROPHOTOGRAPHIC COLOR IMAGE FORMING APPARATUS

FIELD OF THE INVENTION AND RELATED ART

The present invention relates to an electrophotographic color image forming apparatus employing a process cartridge which has an electrophotographic photosensitive drum, and means for processing the electrophotographic photosensitive member, and which is removably mountable in the main assembly of the image forming apparatus.

Here, an electrophotographic color image forming apparatus is an apparatus, such as an electrophotographic color copying machine, an electrophotographic color printer (color laser printer, color LED printer, etc.), or the like, which forms a color image on recording medium, with the use of an electrophotographic image forming process.

Recording means is medium, such as recording paper, OHP sheet, label, or the like, on which an image is formed with the use of the electrophotographic image forming process.

A process cartridge means a cartridge in which an electrophotographic photosensitive drum, and one or more process means for processing the electrophotographic photosensitive drum, are integrally disposed so that they can be removably mountable in the main assembly of the image forming apparatus. More specifically, a process cartridge is a cartridge in which an electrophotographic photosensitive drum, and at least one among the abovementioned processing means, such as a developing means, a charging means, and a cleaning means, are integrally disposed.

The main assembly of an electrophotographic image forming apparatus means what is left after the removal of the process cartridges from the electrophotographic image forming apparatus.

A process cartridge is removably mountable in the main assembly of an image forming apparatus by a user himself or herself. Therefore, a process cartridge makes it possible for a user to maintain an image forming apparatus without relying on service personnel. Therefore, the employment of a process cartridge system drastically improves an electrophotographic image forming apparatus in operability.

There have been known various structural arrangements for establishing electrical connection between a process cartridge and the main assembly of an electrophotographic color image forming apparatus.

For example, an electrophotographic image forming apparatus is structured so that multiple process cartridges are vertically juxtaposed in the movable guide rotatable about its axis. The process cartridges are moved by the rotational movement of the movable guide between the preset cartridge positions (image forming positions) in the apparatus main assembly, and the preset outward positions where they are mountable into, or removable from, the movable guide (apparatus main assembly). Further, the movable guide is provided with an intermediary electrical contact(s).

In this structural arrangement, the electrical connection between the electrical contact on the cartridge side and the electrical contact on the apparatus main assembly side is established through the intermediary electrical contact (U.S. Pat. No. 7,092,657).

This structural arrangement ensures that electrical connection is established between the electrical contacts on the cartridge side and those on the apparatus main assembly side.

That is, it is excellent in terms of the electrical connection between the main assembly of an image forming apparatus, and a process cartridge.

In recent years, in the field of an electrophotographic color image forming apparatus, it has been thought of structuring an image forming apparatus so that multiple process cartridges are supported in the apparatus main assembly by being placed side by side in a movable member which is linearly movably relative to the apparatus main assembly. This structural arrangement is smaller in the amount of space required for the movement of the movable member than the structural arrangement in which the movable member is rotationally moved.

The present invention is one of the further developments of the above described structural design for an electrophotographic color image forming apparatus.

SUMMARY OF THE INVENTION

Thus, the primary object of the present invention is to provide an electrophotographic color image forming apparatus structured to ensure that electrical connection is made between the electrical contacts on the process cartridge side and the corresponding electrical contacts smoothly on the apparatus main assembly side.

Another object of the present invention is to provide an electrophotographic color image forming apparatus structured so that electrical connection is made between the sets of electrical contacts which multiple process cartridges have, and the corresponding sets of electrical contacts on the apparatus main assembly side, with the use of an electrically conductive common member which is shared by the sets of electrical contacts on both sides.

Another object of the present invention is to provide an electrophotographic color image forming apparatus which uses an electrically conductive common member to make electrical connection between the sets of electrical contacts of on the process cartridge side, and the sets of electrical contacts on the main assembly side of the image forming apparatus, being therefore significantly smaller in the number of components for making electrical connection between the process cartridge side and main assembly side than an electrophotographic color image forming apparatus in accordance with the prior art, the number of the components of which for electrical connection between the cartridge side and main assembly side is roughly proportional to the number of the process cartridges it uses.

According to an aspect of the present invention, there is provided a color electrophotographic image forming apparatus including a main assembly to which process cartridges each including an electrophotographic photosensitive drum and process means actable on said electrophotographic photosensitive drum are detachably mountable, said color electrophotographic image forming apparatus comprising a movable member having a supporting portion for supporting a plurality of said process cartridges in juxtaposition, said movable member being movable between a set position inside said main assembly of the apparatus and a position outside said main assembly of the apparatus in a direction crossing a longitudinal direction of said electrophotographic photosensitive drum of said process cartridge in a state in which a plurality of said process cartridges are supported on said supporting portion; a common electroconductive member extended on said movable member in a direction of movement of said movable member, said common electroconductive member being provided adjacent to longitudinal ends of said process cartridges supported on said supporting member;

an electrical contact portion which is provided, for each of said supporting portions, on said movable member and which is electrically connected with said common electroconductive member, said electrical contact portion being electrically connectable with a cartridge electrical contact provided on each of said process cartridges; a main assembly electrical contact electrically connectable with said common electroconductive member to supply electric power to said common electroconductive member from said main assembly of the apparatus at least when said movable member is placed at the set position, wherein the electric power can be supplied from the main assembly of the apparatus to each of the process cartridges supported on said supporting portion of said movable member placed at the set position through said main assembly electrical contact, said common electroconductive member and each of said electrical contact portions.

The present invention makes it possible to provide an electrophotographic color image forming apparatus which is no greater in the component count, and yet, is significantly more reliably in terms of the electrical connection between the electrical contacts on the cartridge side and the electrical contacts on the main assembly of the apparatus, than an electrophotographic color image forming apparatus in accordance with the prior art.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment

General Structure of Electrophotographic Image Forming Apparatus

Figure 1:
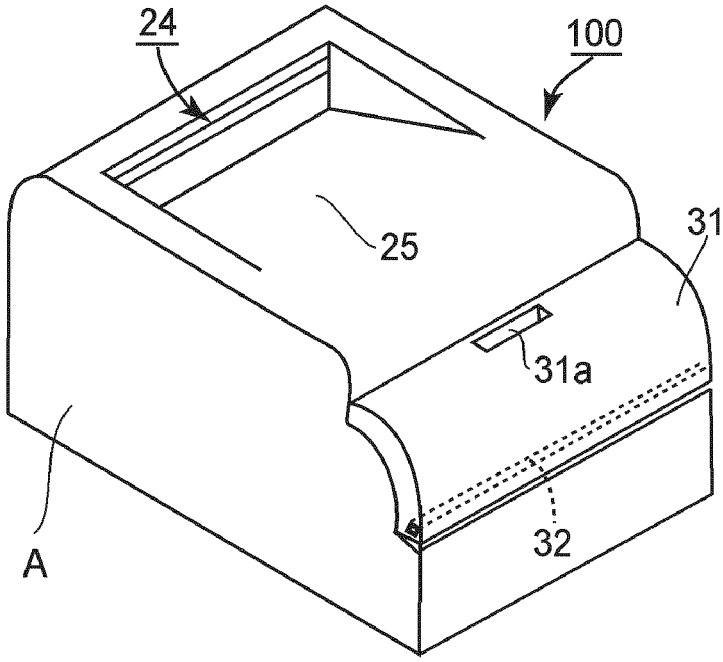
FIG. 1 is an external perspective view of the image forming apparatus in one of the preferred embodiments of the present invention.
Figure 2:
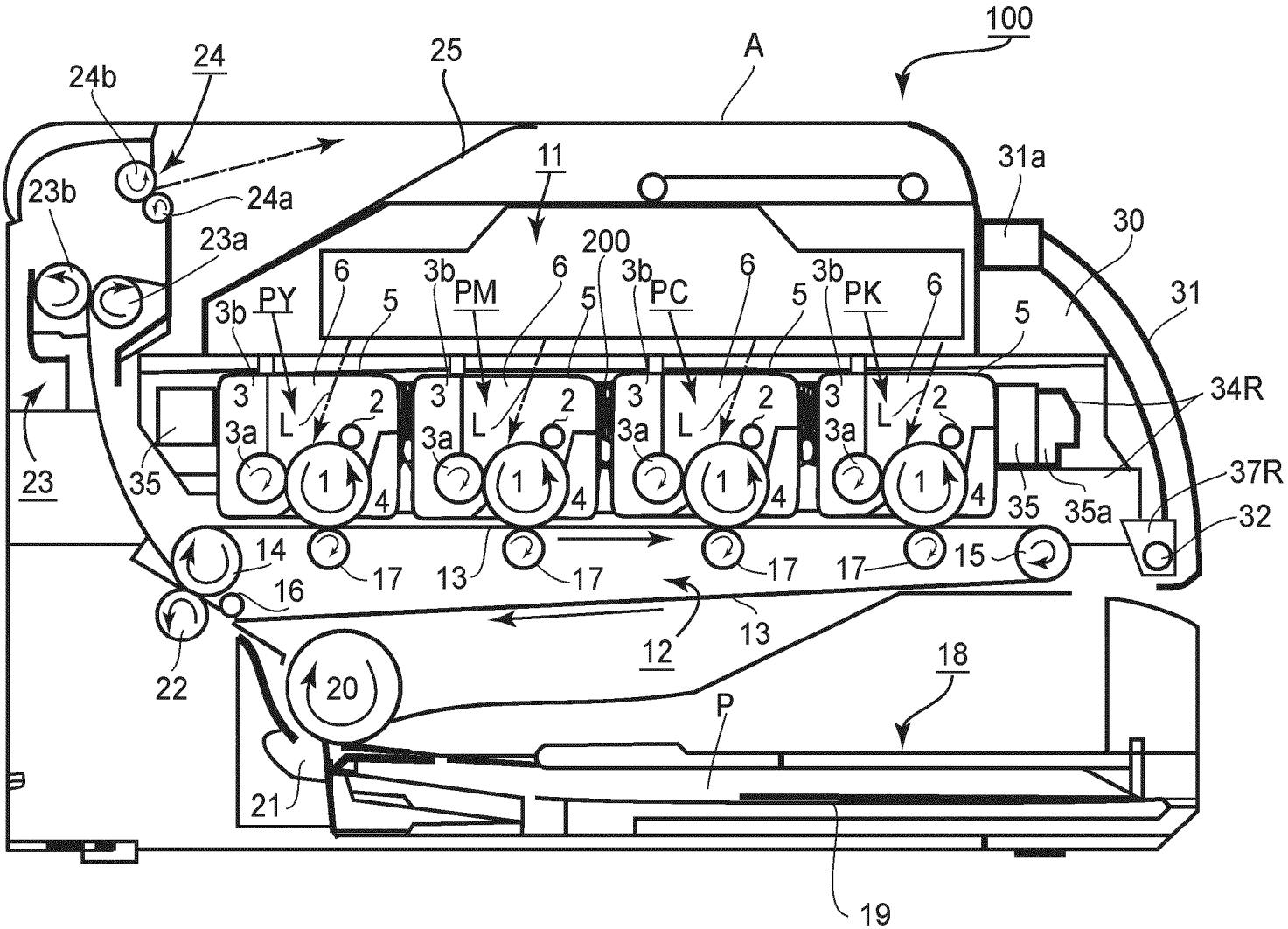
FIG. 2 is a vertical sectional view of the image forming apparatus shown in FIG. 1, as seen from the left side of the apparatus.

FIG. 1 is an external perspective view of the electrophotographic color image forming apparatus 100 in this embodiment. FIG. 2 is a vertical sectional view of the image forming apparatus shown in FIG. 1, as seen from the left side of the apparatus. This image forming apparatus 100 is a full-color printer, which employs an electrophotographic image forming process, and uses four inks different in color. It forms an image on recording medium in response to electrical picture signals inputted from an external host apparatus (unshown), such as a personal computer, an image reader, a facsimile machine (from which image is sent), and the like.

In the following description of the preferred embodiment of the present invention, the front side (front surface side) of the image forming apparatus 100 means the side which has a door 31. The rear side of the image forming apparatus is the side opposite to the front side. The fore-and-after direction includes both the frontward and rearward directions. The left and right sides of the apparatus main assembly means the left and right sides of the apparatus main assembly as seen from the front side of the apparatus main assembly. The side to side direction includes both the leftward and rightward directions.

In the main assembly A of the image forming apparatus 1, multiple process cartridges (first to fourth), that is, PY, PM, PC, and PK are contained. The four cartridges PY, PM, PC, and PK are horizontally arranged in the listed order in the rear-to-front direction of the apparatus main assembly A (which may be referred to as inline or tandem arrangement).

The four cartridges PY, PM, PC, and PK are the same in structure, although they are different in the color of the developers they store.

Each cartridge in this embodiment is an assembly which has: an electrophotographic photosensitive drum 1; processing means, more specifically, a charging means 2, a developing means 3, and a cleaning means 4, which process the drum 1; and a cartridge in which the preceding components and means are integrally disposed. As the charging means 2, a charge roller is used. As a developing means 3, a development roller 3*a* is used. In the developer container 3*b* of the developing means 3, developer is stored. As the cleaning means 4, a cleaning blade is used.

The developer container of the first cartridge PY stores yellow (Y) developer. On the peripheral surface of the drum 1 in the first cartridge PY, a developer image of yellow (Y) color is formed. The developer container of the second cartridge PM stores magenta (M) developer. On the peripheral surface of the drum 1 in the second cartridge PM, a developer image of magenta (M) color is formed. The developer container of the third cartridge PC stores cyan (C) developer. On the peripheral surface of the drum 1 in the third cartridge PC, a developer image of cyan (C) color is formed. The developer container of the fourth cartridge PK stores black (K) developer. On the peripheral surface of the drum 1 of the fourth cartridge PK, a developer image of black (K) color is formed.

In the area above the cartridges PY, PM, PC, and PK, a laser scanner unit 11 is disposed. This scanner unit 11 exposes the peripheral surface of the drum 1 in each cartridge. That is, the scanner unit 11 outputs a beam of laser light L while modulating it with the information regarding the monochromatic color images to be formed by the cartridges, which is inputted from an external host apparatus (unshown). As a result, the peripheral surface of the photosensitive drum 1 in each cartridge is scanned (exposed) by the beam of laser light L through the exposure window 6, with which the top wall of the cartridge frame 5 is provided.

In the area below the cartridge PY, PM, PC, and PK, an intermediary transfer belt unit 12 is disposed, which has a flexible endless belt 13, a driver roller 14, a turn roller 15, and tension roller 16. The endless belt 13 is stretched around the driver roller 14, turn roller 15, and tension roller 16, being thereby suspended by them, so that it can be circularly driven. The driver roller 14 and tension roller 16 are disposed in the rear portion of the apparatus main assembly A, whereas the turn roller 15 is disposed in the front portion of the apparatus main assembly A. Each cartridge is disposed so that the downwardly facing portion of the peripheral surface of the drum 1 remains in contact with the upwardly facing portion of the external surface of the endless belt 13. On the inward side of the loop which the belt 13 forms, four primary transfer rollers 17 are disposed. Each transfer roller 17 is disposed so that it opposes the drum 1 in the corresponding cartridge, with the portion of the endless belt 13, which corresponds to the top portion of the loop, pinched between the transfer roller 17 and drum 1. A secondary transfer roller 22 is disposed outside the belt loop so that it opposes the driver roller 14, with the belt 13 pinched between the two rollers.

In the area below the belt unit 12, a paper feeder unit 18 is disposed, which has a paper tray 19, a paper feeder roller 20, a paper separation pad 21, etc. In the paper tray 19, sheets of recording paper as recording medium are stored in layers. The paper tray 19 is removably mountable in the apparatus main assembly A from the front side (front loading).

In the top portion of the rear portion of the apparatus main assembly A, a fixing apparatus 23 and a pair of discharge rollers 24 are disposed. Further, the top wall of the apparatus main assembly A is shaped so that a part of the wall is utilized as a delivery tray 25. The fixing apparatus 23 has a fixation film assembly 23*a* and a pressure application roller 23*b*. The pair of discharge rollers 24 are rollers 24*a* and 24*b*.

When each of the cartridges PY, PM, PC, and PK is correctly situated in its preset position (which hereafter may be referred to as image forming position, or latent image forming position) in the apparatus main assembly A, it remains securely held to the cartridge positioning portion of the apparatus main assembly A by the pressure applied by a cartridge pressing member (which will be described later in detail), being thereby correctly positioned relative to the apparatus main assembly A. Further, the driving force input portion of the cartridge is engaged with the driving force output portion of the apparatus main assembly. Further, the input electrical contact portion of the cartridge is electrically in connection to the power supply system with which the apparatus main assembly A is provided.

The operation carried out by this image forming apparatus to form a full-color image is as follow:

The drum 1 in each of the first to fourth cartridges PY, PM, PC, and PK is rotationally driven at a preset velocity in the counterclockwise direction indicated by an arrow mark. Further, the belt 13 is circularly driven in the clockwise direction indicated by an arrow mark (subordinate direction to rotational direction of photosensitive drum) at a velocity which corresponds to the peripheral velocity of the drum 1. The scanner unit 11 is also driven. In synchronization with the driving of the scanner unit 11, the charge roller 2 in each cartridge uniformly charges the peripheral surface of the drum 1 to preset polarity and potential, with a preset (controlled) timing. The scanner unit 11 scans (exposes) the peripheral surface of each drum 1 with the beam of laser light L while modulating the beam of laser light L with the picture signals for forming an monochromatic image of the primary color assigned to each cartridge. As a result, an electrostatic latent image, which reflects the picture signals corresponding to the primary color assigned to the cartridge, is effected on the peripheral surface of the drum 1. This electrostatic latent image is developed by the development roller 3*a* into a visible image (image formed of development).

Through the above described electrophotographic image formation process, a yellow developer image, which corresponds to the yellow color component of an intended full-color image, is formed on the drum 1 of the first cartridge PY. This yellow developer image is transferred (primary transfer) onto the belt 13.

On the drum 1 of the second cartridge PM, a magenta developer image, which corresponds to the magenta color component of the full-color image, is formed, and this developer image is transferred (primary transfer) onto the belt 13 so that it is layered on the yellow developer image which is already on the belt 13.

On the drum 1 of the third cartridge PC, a cyan developer image, which corresponds to the cyan color component of the full-color image, is formed, and this developer image is transferred (primary transfer) onto the belt 13 so that it is layered on the yellow and magenta developer images which are already on the belt 13.

On the drum 1 of the fourth cartridge PK, a black developer image, which corresponds to the black color component of the full-color image is formed, and this developer image is transferred (primary transfer) onto the belt 13 so that it is layered on the yellow, magenta, and cyan developer images which are already on the belt 13.

Consequently, an unfixed full-color developer image is effected on the belt 13 by the four monochromatic color developer images, that is, the yellow, magenta, cyan, and black color development images.

After the primary transfer of the developer image onto the belt 13, the developer remaining on the peripheral surface of the drum 1 in each cartridge is removed by the cleaning means 4.

Meanwhile, the paper feeder roller 20 is driven with the preset (controlled) timing. As the paper feeder roller 20 is driven, one of the sheets of recording medium P (recording paper, OHP sheet, etc.,) stacked in the paper tray 19 is separated from the rest of the sheets of recording medium P by the coordination of the sheet feeder roller 20 and separation pad 21, and is fed into the apparatus main assembly A by the sheet feeder roller 20. Then, the recording medium P is introduced into the nip (secondary transfer nip), that is, the interface between the secondary transfer roller 17 and belt 13, and then, is conveyed through the nip (secondary transfer nip) which the secondary transfer roller 22 and belt 13 form, while remaining pinched by the secondary transfer roller 22 and belt 13. While the recording medium P is conveyed through the nip, the four layers of developer images, different in color, on the belt 13 are transferred together onto the recording medium P as if they were peeled away from the belt 13, starting at their leading edges.

The recording medium P is separated from the surface of the belt 13, and is introduced into the fixing apparatus 23, and is subjected to heat and pressure in the fixation nip of the fixing apparatus 23. As a result, the four layers of developer images different in color are fixed to the recording medium P while being blended. Thereafter, the recording medium P is moved out of the fixing apparatus 23, and then, is discharged as a full-color copy onto the delivery tray 25 by the pair of discharge rollers 24.

After the separation of the recording medium P from the belt 13, the secondary transfer residual developer, that is, the developer remaining on the surface of the belt 13 after the separation of the recording medium P from the belt 13, is removed by a cleaning means 4. That is, in this embodiment, the secondary transfer residual developer electrostatically adheres to the peripheral surface of the drum 1 in the primary transfer nip of the first cartridge PY, for example, and then, it is removed from the drum 1 by the cleaning means 4.

(Method for Replacing Cartridge)

As an image forming operation is carried out by each of the first to fourth cartridges PY, PM, PC, and PK, the developer stored in the developing means 3 of each cartridge is consumed.

Thus, the image forming apparatus is provided with a means (unshown) for detecting the amount of the developer remaining in each cartridge. The detected amount of the developer in each cartridge is compared, by the control portion (unshown), with a threshold value preset for issuing a warning, such as a warning that the cartridge is near the end of its service life, or the cartridge has reached the end of its service life. If the detected amount of the residual developer in the cartridge is smaller than the preset threshold value, the message which warns the user that the cartridge is close to the end of its life or has reached the end of its life is displayed on the monitor portion (unshown); in other words, the image forming apparatus prompts the user to prepare a replacement cartridge, or to replace the cartridge, in order to maintain a preset level of image quality.

In order to improve the image forming apparatus in usability, the image forming apparatus in this embodiment is provided with a cartridge tray (cartridge drawer: movable member which is movable while holding cartridges), which can be pulled out frontward to make it easier for a user to access the cartridges from the front side of the apparatus, in order to replace the cartridge.

The cartridge tray 35 is provided with multiple cartridge supporting portions (cartridge bays), in which multiple cartridges are held one for one. The cartridge supporting portion (cartridge bays) are juxtaposed in parallel.

In this embodiment, the cartridge tray 35 is provided with four cartridge supporting portions 35Y, 35M, 35C, and 35K (FIG. 9A), in which first to fourth cartridge PY, PM, PC, and PK are placed, being supporting thereby, respectively. The cartridge tray 35 is movable in the direction perpendicular to the lengthwise direction of the drum 1 in the cartridge held in the cartridge tray 35, between its innermost position, that is, its image formation position, in the apparatus main assembly A, and its outermost position from the apparatus main assembly A.

When the cartridge tray 35 is in the most outward position relative to the apparatus main assembly A, all the cartridges in the tray are outside the apparatus main assembly A, making it easier for the user to replace any cartridge in the tray.

More specifically, the front wall of the image forming apparatus is provided with an opening 30, through which the cartridge (cartridge tray) can be inserted into, or removed from (pulled out of), the apparatus main assembly A. That is, the apparatus main assembly A has the opening 30 (FIG. 2) through which the cartridge (cartridge tray) is allowed to pass.

Further, the apparatus main assembly A is provided with a door 31, which can be rotationally moved between the closed position in which it covers the opening 30, and the open position in which it exposes the opening 30.

In this embodiment, this door 31 is rotationally movable relative to the apparatus main assembly A about a horizontal shaft 32 (door hinge shaft) located at the bottom edge of the door 31. That is, the door 31 is rotatable about the hinge shaft 32 in a manner to be rotationally raised upward so that it can be moved into the closed position, in which it remains shut against the apparatus main assembly A, covering the opening 30 (FIGS. 1 and 2), and also, so that it can be rotated frontward about the hinge shaft 32 into the open position, in a manner to be laid down (FIGS. 4 and 5) to widely expose the opening 30. Designated by a referential character 31*a* is a handle, with which the door 31 is provided.

The apparatus main assembly A is provided with a pair of tray supporting members 34L and 34R (tray moving means) (FIG. 4), which are attached one for one to the inward side of the left and right panels 81L and 81R of the main frame (FIG. 17) of the apparatus main assembly A, opposing each other. The cartridge tray 35 is supported between the pair of holding members 34L and 34R, and by the pair of holding members 34L and 34R, being enabled to horizontally slide in the fore-and-after direction of the apparatus main assembly A. The cartridges PY, PM, PC, and PK are supported by the supporting portions 35Y, 35M, 35C, and 35B of the tray 35.

Figure 4:
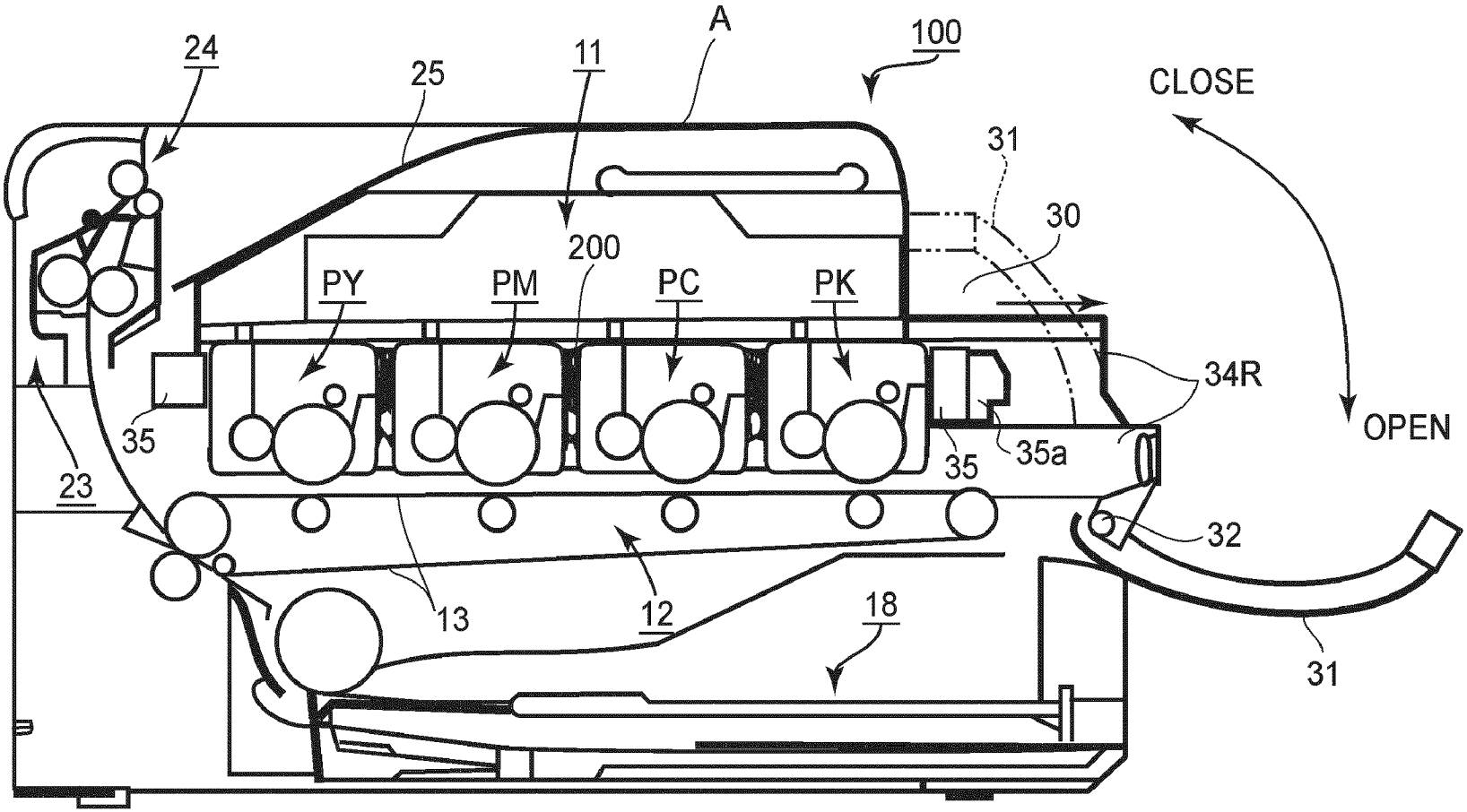
FIG. 4 is a vertical sectional view of the image forming apparatus, shown in FIG. 3, as seen from the left side of the apparatus main assembly.
Figure 5:
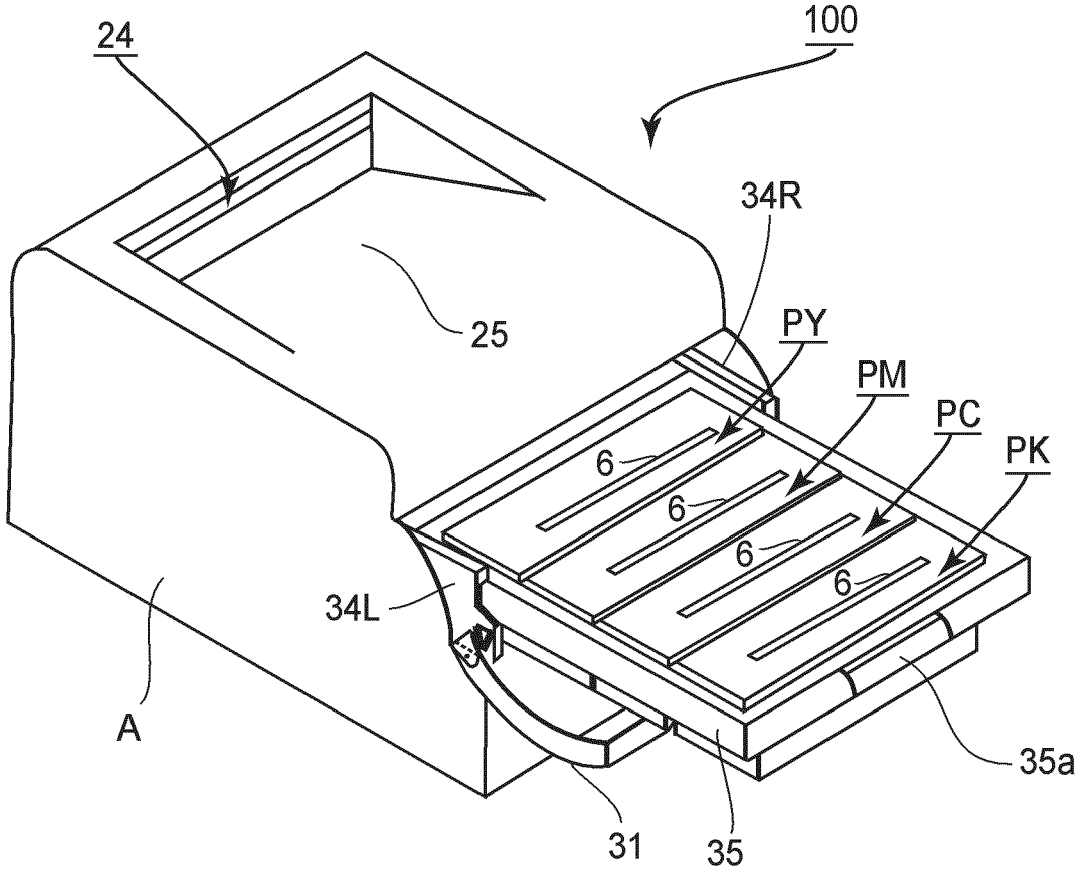
FIG. 5 is an external perspective view of the image forming apparatus, shown in FIG. 1, the tray of which has been pulled out further from the tray position shown in FIG. 3.

As the door 31 is opened, the holding members 34L and 34R are moved both frontward and upward of the apparatus main assembly A, that is, slantingly upward, by preset distances, by the movement of the door 31. As a result, the holding members 34L and 34R are pulled out of the apparatus main assembly A through the opening 30 so that the front end portion of each holding member 34 extends outward of the apparatus main assembly A by a preset distance (FIGS. 4 and 5). The mechanism which causes the holding members 34L and 34R to be moved by the movement of the door 31 will be described later.

As the holding members 34L and 34R are moved outward, the driving force output portions of the apparatus main assembly are disengaged from the corresponding driving force input portions of the cartridges PY, PM, PC, and PK, respectively (disengagement of driving force transmitting means). Further, the pressure applied to each cartridge by the pressure applying member to secure and correctly position the cartridge is removed from the cartridge (pressure removal). Further, the electrical contacts of each cartridge are disengaged from the power supply system of the apparatus main assembly, making it thereby impossible for electric power to be supplied to the cartridge from the power supplying system on the apparatus main assembly side (electrical disengagement). Further, the tray 35 is freed from its positional restriction.

Figure 6:
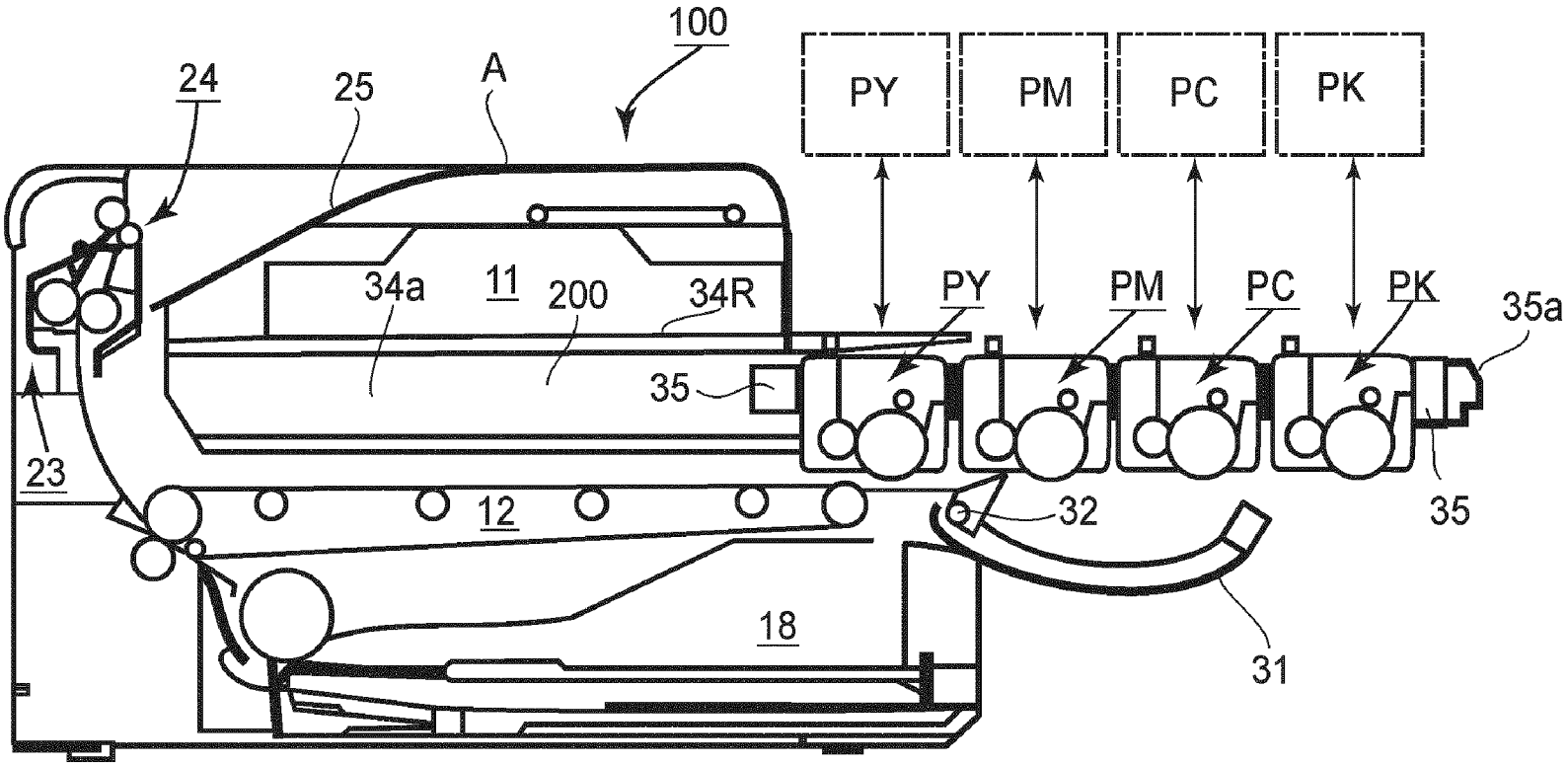
FIG. 6 is a vertical sectional view of the image forming apparatus, shown in FIG. 4, the tray of which has been pulled out further from the tray position shown in FIG. 4, as seen from the left side of the apparatus.

At this point, the user is to grasp the handle 35*a* exposed through the opening 30, and pull the tray 35 in the horizontal and frontward direction to slide the tray 35 relative to the pair of holding members 34L and 34R so that the tray 35 comes out of the apparatus main assembly A through the opening 30, and moves into its preset most outward position (FIGS. 5 and 6).

As the tray 35 is pulled out to the abovementioned preset position, the first-fourth cartridges PY, PM, PC, and PK held in the tray 35 are all moved out of the apparatus main assembly A through the opening 30, being exposed from the apparatus main assembly A; the top surface of each cartridge is exposed. The apparatus main assembly A is structured so that as the tray 35 is pulled out by a preset distance which is sufficient to expose all the cartridges, it is prevented by a pair of stoppers (unshown) from being pulled out further, and also, so that once the tray 35 is pulled out to the preset most outward position, it is securely retained in this most outward position by the holding members 34L and 34R.

The tray 35 is structured so that each cartridge can be moved out straight upward from the tray 35, and also, so that the replacement cartridge for each of the first to fourth cartridges can be mounted straight downward into the tray 35 from directly above. Thus, the user is to extract from the tray 35 the cartridge or cartridges, which are to be replaced, that is, the cartridge or cartridges, the life of which has expired, by simply lifting it, as indicated by a double-dot chain line in FIG. 6 and then, fit a brand-new cartridge or cartridges, from directly above, into the vacated space or spaces, one for one, in the tray 35.

In the embodiment described above, the tray 35 is a movable member which is movable in the direction intersectional (perpendicular) to the lengthwise direction (axial line) of the drum 1 of the cartridge, and is enabled to move between its preset most inward position (image formation position) in the apparatus main assembly A and its preset most outward position from the apparatus main assembly A. More specifically, the tray 35 can be moved outward of the apparatus main assembly A through the abovementioned opening 30 to its preset outermost position where the cartridges can be removed from, or mounted into, the tray 35, and also, can be moved inward of the apparatus main assembly A, into its preset transitional position, from which it is moved diagonally downward. Further, the tray 35 can be moved into the latent image formation position where an electrostatic latent image can be formed on the drum 1.

In this embodiment, the tray 35 holds the cartridges PK, PC, PM, and PY, in which the developers of K, C, M, and Y colors, respectively, are stored. The order in which the cartridges PK, PC, PM, and PY are arranged in the tray 35 is the same as they are listed above. Namely, in terms of the upstream to downstream direction, that is, the direction in which the tray 35 is moved inward of the apparatus main assembly A from outward of the apparatus main assembly A, the cartridges PK, PC, PM, and PY are arranged in the listed order. In other words, in this embodiment, the cartridges are arranged according to the amount of developer consumption, so that the cartridge highest in developer consumption, that is, the cartridge highest in replacement frequency, is placed closest to the front side, that is, the side from which the user operates the image forming apparatus. Therefore, the distance by which the tray 35 must be pulled out of the apparatus main assembly to expose the cartridge PK is very small. Thus, the image forming apparatus A in this embodiment is superior in operability to an image forming apparatus in accordance with the prior art, in terms of the efficiency with which the cartridge PK can be replaced.

The left and right holding means 34L and 34R are the means for diagonally upwardly moving the tray 35 from its preset innermost position before moving the tray 35 into the area in which the cartridge(s) can be removed from, or placed into, the tray 35. They also constitute the means for downwardly moving the tray 35 into its preset innermost position. In other words, the holding means 34L and 34R are members for supporting the tray 35. In terms of the vertical direction, they are enabled to move to, and remain at, a first level, or a second level. The first level allows the tray 35 to be moved between the area in which the cartridge(s) can be mounted into, or removed from, the tray 35, and the abovementioned transitional position. The second level keeps the tray 35 in the abovementioned latent image formation position. Further, as the door 31 is closed, the holding members 34L and 34R moves from the first level to the second level.

Figure 7:
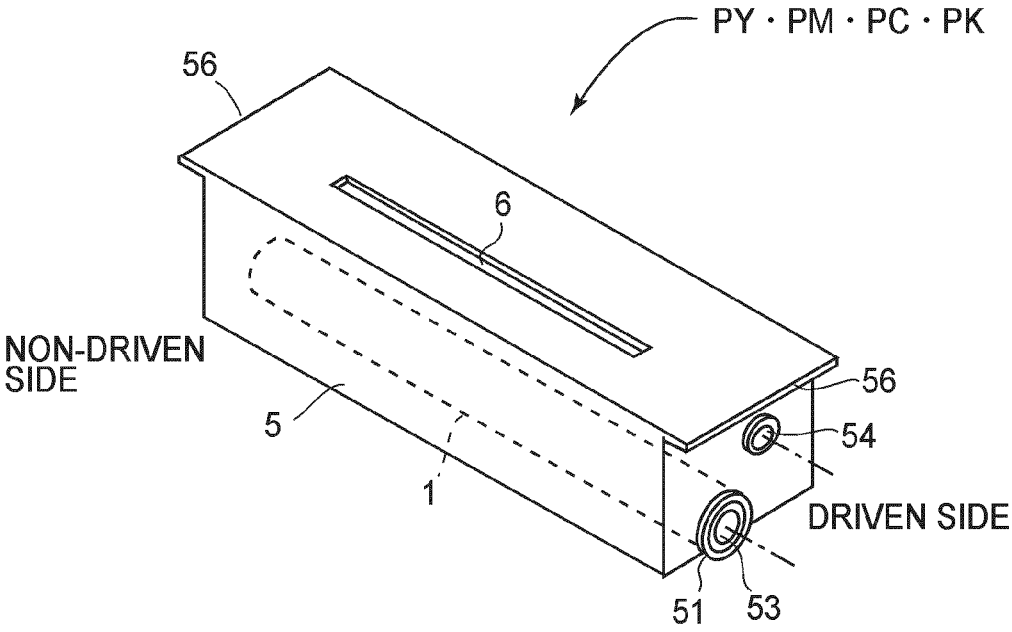
FIG. 7 is an external perspective view of the cartridge, as seen from the side from which the cartridge is driven.
Figure 8:
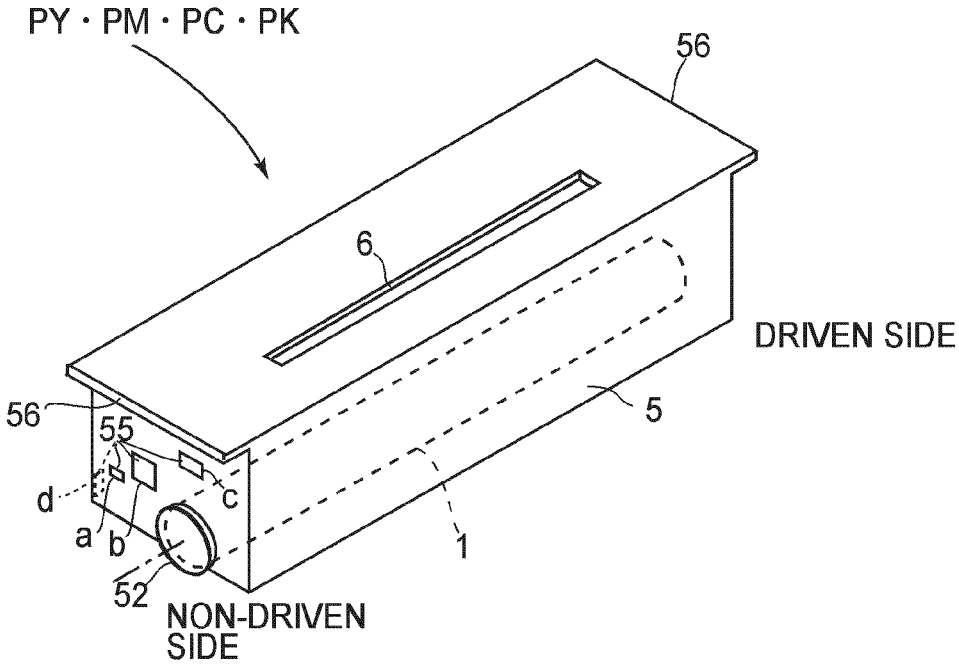
FIG. 8 is an external perspective view of the cartridge, as seen from the side from which the cartridge is not driven.

FIGS. 7 and 8 are external perspective views of one of the cartridges, as seen from the side from which the cartridge is driven, and the side from which the cartridge is not driven.

Each cartridge is an assembly which is roughly in the form of a rectangular parallelepiped, and its left-and-right direction, that is, the lengthwise direction, is parallel to the axial line of the drum 1. The drum 1 is rotatably supported between the bearing portions 51 and 52, with which the right and left panels of the cartridge frame 5 formed of synthetic resin are provided, respectively. The right bearing portion 51 is provided with a coupler 53 as a drum driving force input portion. Further, the right panel of the cartridge frame 5 is provided with a coupling 54 as a developing means driving force input portion for driving the development roller 3*a*. The left wall of the cartridge frame 5 is provided with electrical contacts 55 of the cartridge. More specifically, each cartridge is provided with four electrical contacts 55 (different in locations), which are for the charge roller 2, development roller 3*a*, developer supply member (unshown), and developer regulating member (unshown), one for one. Of the four electrical contacts 55 of the cartridge, the electrical contact designated by a referential letter a is in connection to the development roller 3*a*, and receives the development bias supplied to the development roller 3*a* from the apparatus main assembly A. The electrical contact designated by a referential letter b is in connection to the developer regulating member (unshown), and receives the developer regulating member bias supplied to the developer regulating member (unshown) from the apparatus main assembly A. The electrical contact designated by a referential letter c is in connection to the charge roller 2, and receives the charge bias supplied to the charge roller 2 from the apparatus main assembly A. The electrical contact designated by a referential letter d is in connection to the developer supply member (unshown), and receives the developer supply member bias supplied to the developer supply member from the apparatus main assembly A.

The three electrical contacts a, b, and c are exposed at the outward surface of one of the end walls of the cartridge in terms of the lengthwise direction of the photosensitive drum 1, whereas the electrical contact d is exposed at the outward surface of the leading wall of the tray 35, in terms of the direction in which the tray 35 is moved from outside the apparatus main apparatus into the apparatus main assembly.

Of the cartridges described above, the right-hand side of each cartridge, that is, the side having the couplers 53 and 54, may be referred to as drivable side, and the left-hand side, that is, the opposite side from the drivable side, may be referred to as non-drivable side.

Figure 9A:
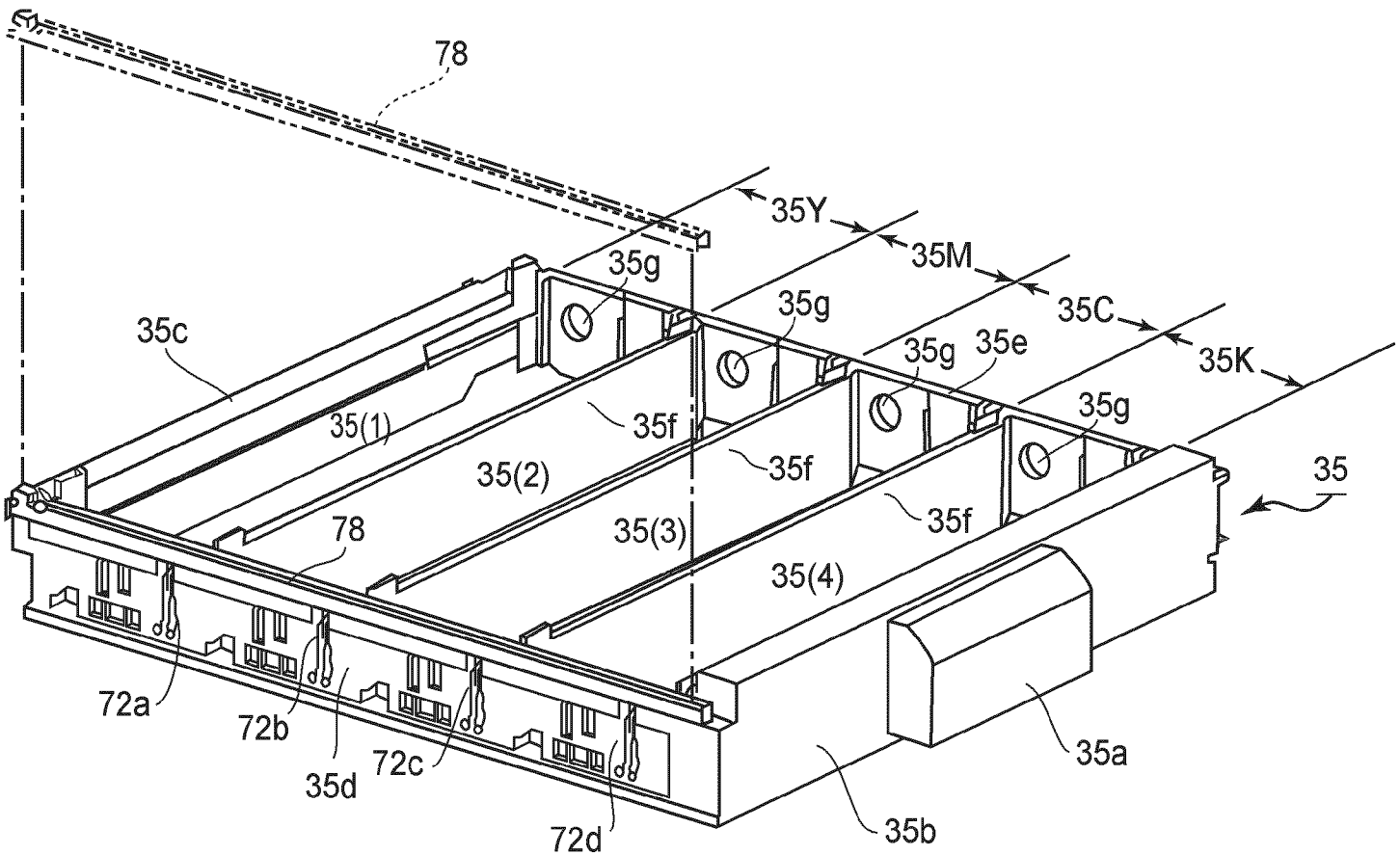
FIG. 9A is a perspective view of the tray.

FIG. 9A is an external perspective view of the tray 35. The tray 35 has a rectangular main frame, which is made up of four sections 35*b* (front), 35*c* (rear), 35*d* (left), and 35*e* (right), which are formed of a dielectric substance and are joined at their lengthwise ends. The space within the rectangular main frame is partitioned into four sub-spaces of roughly the same size by three partition plates 35*f* which extend in the direction parallel to the left-and-right direction of the apparatus main assembly, connecting the left and right sections of the main frame. Hereafter, these four sub-spaces will be referred to as first-fourth cartridge bays 35(1)-35(4), listing from the rear section 35*c* side toward the front section 35*b*. These cartridge bays 35(1)-35(4) are the first to fourth cartridge supporting portions 35Y, 35M, 35C, and 35K (cartridge compartments) in which the first to fourth cartridges PY, PM, PC, and PK are held, respectively. The portions of the rear section 35*e* of the main frame of the tray 35, which correspond to the cartridge bays 35(1)-35(4), are provided with a hole 35*g*, which is for allowing the development roller driving coupler to move into, or out of, the corresponding cartridge bay.

Incidentally, designated by a referential number 200 (FIGS. 2, 4, and 6) is a cartridge placement second space (cartridge storage compartment, cartridge placement position, image formation position). Each cartridge held in the cartridge placement spaces 200 receives driving force from the apparatus main assembly A through the drum driving coupler 39 and development roller driving coupler 40. Further, when the cartridges are in the cartridge placement second space 200, they are electrically in connection to the apparatus main assembly A.

Figure 21:
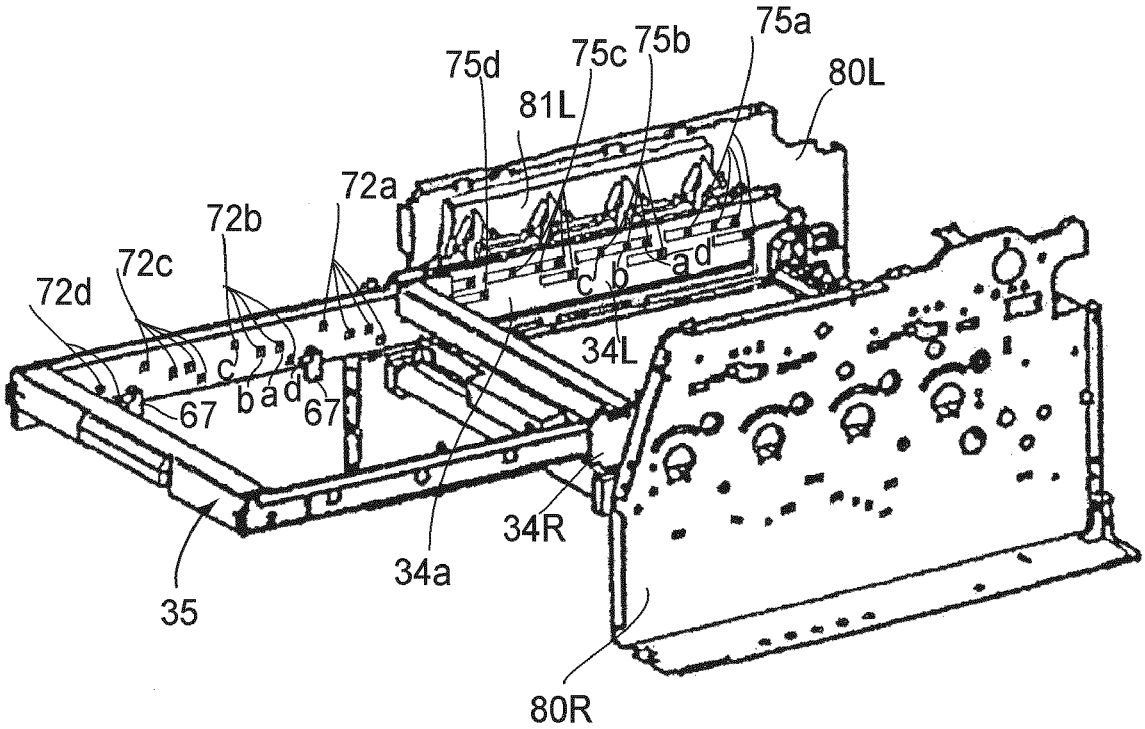
FIG. 21 is a drawing (1) showing the means for supplying electric power to a cartridge.

Further, the tray 35 is provided with intermediary electrical contacts 72*a*-72*d* (FIG. 21), each of which makes contact with the electrical contact 55 (FIG. 8) of the corresponding cartridge. These intermediary electrical contacts 72*a*-72*d* are electrically connectible to the electrical contacts 75*a*-75*d* (FIGS. 21 and 22) with which the apparatus main assembly is provided. These electrical contacts and their connection will be described later. Incidentally, the electrical contacts 75*a*-75*d* on the main assembly side is indirectly connected to the electrical contacts 55*a*-55*d* on the cartridge side, respectively. The electrical contact a is for supplying development roller 3*a* with development bias, and the electrical contact b is for supplying the developer regulating member (unshown) with regulating member bias. Further, the electrical contact c is for supplying the charge roller 2 with charge bias, and the electrical contact d is for supplying the developer supply member (unshown) with supply member bias (FIGS. 8 and 21). Incidentally, the electrical contacts 72*a*-72*d* correspond to the cartridge supporting portions 35Y, 35M, 35C, and 35K.

Each cartridge is to be inserted from directly above into one of the sub-spaces (cartridge supporting portions 35Y, 35M, 35C, and 35K) of the tray 35, which has been predesignated for the cartridge. As the cartridge is inserted, the left and right overhangs 56 are caught, by their bottom surfaces, by the top surfaces of the left and right sections 35*d* and 35*e* of the main frame of the tray 35; in other words, the cartridge is supported by the tray 35. That is, the tray 35 supports each cartridge so that the cartridge can be removed from the tray 35 in the vertically upward direction; in other words, as each cartridge is moved downward into the tray 35 from directly above the tray 35, the cartridge is supported by the tray 35. The tray 35 loosely supports each cartridge. This structural arrangement makes it easier for a user to replace the process cartridges.

Figure 10:
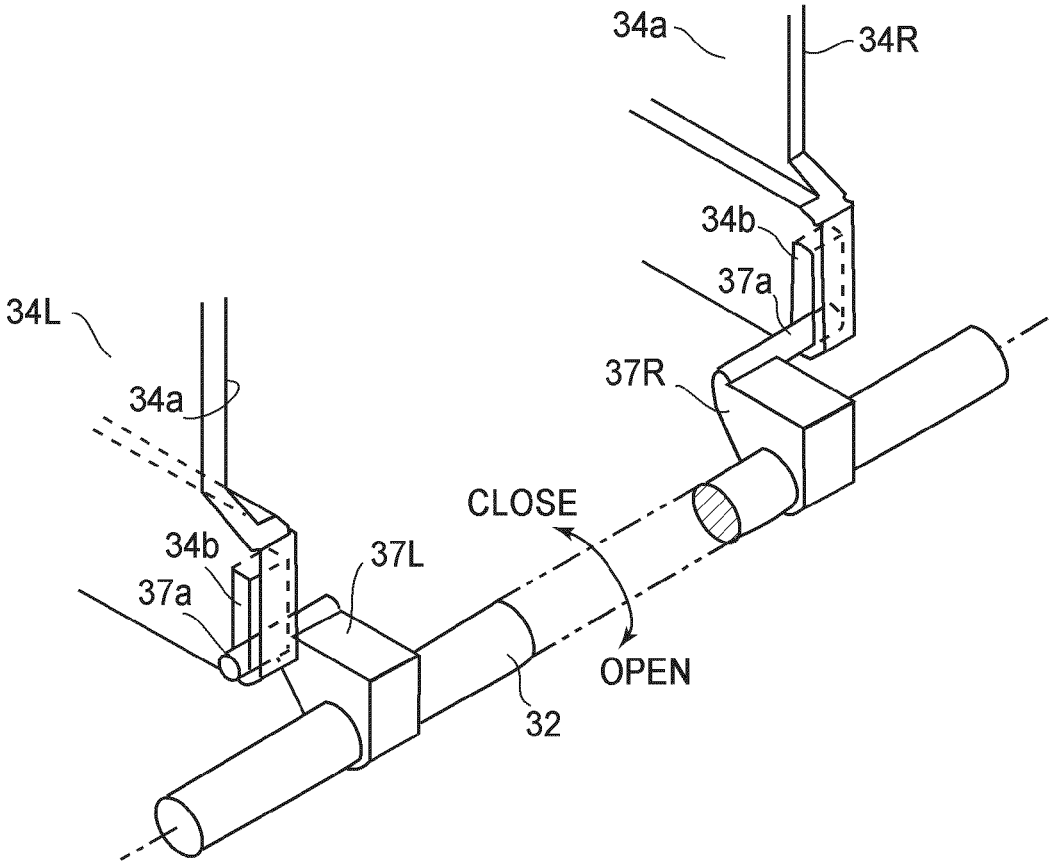
FIG. 10 is a perspective view of the mechanical linkage between the door and tray holding members.

The inward surface of the left holding member 34L and the inward surface of the right holding member 34R are provided with a guiding groove 34*a* (FIGS. 6, 10, and 21). The left and right sections of the main frame of the tray 35 fit in these grooves 34*a*, one for one. Thus, not only is the tray 35 supported between the left and right holding members 34L and 34R, but also, it is allowed to slid in the fore-and-aft direction, with the left and right sections 35*d* and 35*e* of its main frame sliding in the guiding grooves 34*a* of the holding members 34L and 34R.

Figure 3:
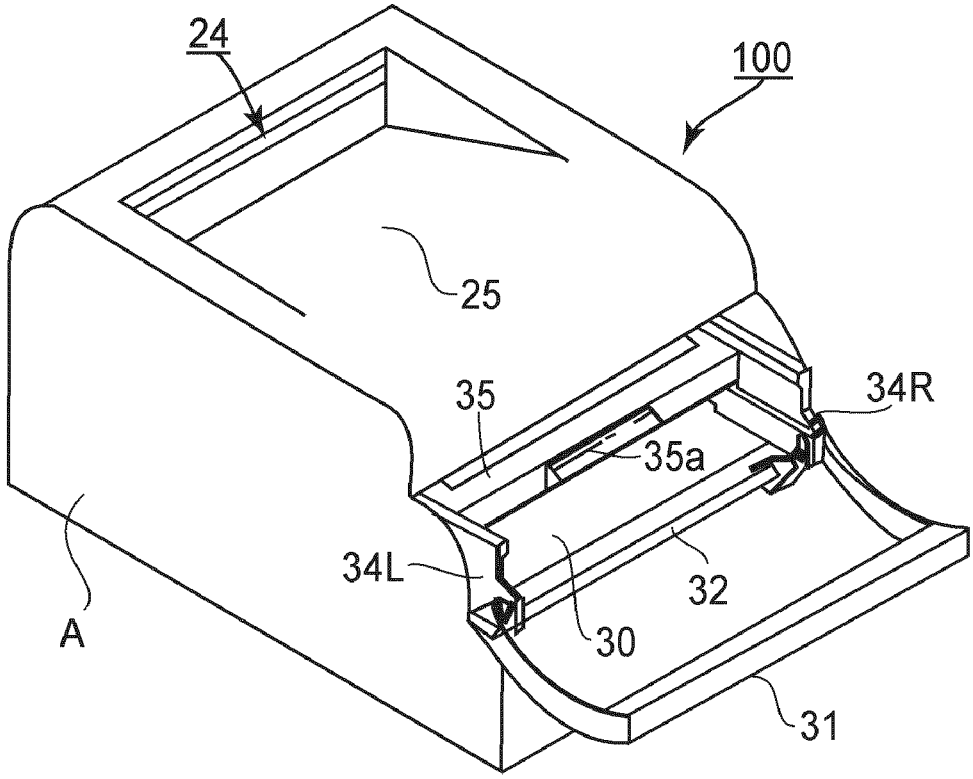
FIG. 3 is an external perspective view of the image forming apparatus, shown in FIG. 1, the font door of which is open.

Referring to FIGS. 5 and 6, after the tray 35 is drawn out into its outermost position, and the cartridge, or cartridges, in the tray 35, which are to be replaced, are replaced, the tray 35 is to be pushed in the direction opposite to the direction in which it is pulled out of the apparatus main assembly; in other words, the tray 35 is to be pushed back all the way into the apparatus main assembly. That is, the tray 35 is to be returned to the position, shown in FIGS. 3 and 4, in which the tray 35 was before it was pulled out. Thereafter, the user is to close the door 31 against the frame of the apparatus main assembly, as shown in FIGS. 1 and 2.

As the door 31 is closed, the holding members 34L and 34R are moved downwardly rearward, by the preset distance, by the rotational closing movement of the door 31. As a result, each cartridge is moved into its designated position in the apparatus main assembly. Further, the movement of the holding members 34L and 34R causes the cartridge pressing members to apply pressure to the corresponding cartridges to secure the cartridges in their preset positions. As a result, the downwardly facing area of the peripheral surface of the drum 1 in each cartridge comes into contact with the point (area) of the belt 13, which coincides with the specific point preset for each cartridge. In addition, each of the driving force outputting portions of the apparatus main assembly engages with the driving force input portion of the corresponding cartridge, and also, electrical connection is established between the power supply system of the apparatus main assembly and the electrical contacts of each cartridge. That is, while each cartridge is moved downward by the downward movement of the tray 35, the abovementioned intermediary electrical contacts 72*a*-72*d* become electrically connected to the electrical contacts 75*a*-75*d* (electrical contacts on the main assembly side), respectively, establishing thereby the electrical connection between the contacts 75*a*-75*d* on the main assembly side and the electrical contacts 55 on the cartridge side.

(Mechanical Linkage between Door 31 and Holding Members 34L and 34R)

FIG. 10 is a perspective view of the mechanical linkage between the door 31 and holding members 34L and 34R. The hinge shaft 32 of the door 31 is horizontally disposed in parallel to the left and right direction of apparatus main assembly A. The hinge shaft 32 is rotatably supported at its lengthwise ends by, and between, the left and right frames 80L and 80R (FIG. 17) of the apparatus main assembly. The door 31 is solidly attached to the hinge shaft 32. Thus, as the door 31 is rotationally opened or closed, the hinge shaft 32 rotates with the door 31. The hinge shaft 32 is provided with a pair of connective arms 37L and 37R, which are attached to the portions of the hinge shaft 32, which are close to the left and right lengthwise ends of the hinge shaft 32. The arms 37L and 37R are solidly attached to the hinge shaft 32 so that they are the same in rotational phase. The arms 37L and 38R are provided with their own horizontal shaft 37*a*. The horizontal arm 37*a* of the left arm 37L is fitted in a hole 34*b* with which the bottom front portion of the left holding member 37L is provided, and the horizontal shaft 37*a* of the right arm 37R is fitted in a hole 34*b* with which the bottom front portion of the right holding member 34R is provided. Both holes 34*b* are elongated in cross-section.

In other words, the hinge shaft 32 is connected to the holding members 34L and 34R, with the interposition of the arms 37L and 37R, shafts 37*a*, and holes 34*b*. Thus, as the door 31 is opened or closed, the force applied to the door 31 to move the door 31 is transmitted to the left and right holding members 34L and 34R in a manner to move them in the fore-and-aft direction.

Each of the holding members 34L and 34R is provided with a pair of pins 34*c*, which are protruding from the front and rear portions (with presence of preset distance) of the holding member. Further, each of the left and right frames 80L and 80R are provided with a pair of guiding slots 36. The pins 34*c* are fitted in these guiding slots 36, one for one, whereby the holding members 34L and 34R are supported by the left and right frames 80L and 80R, respectively.

Figure 11:
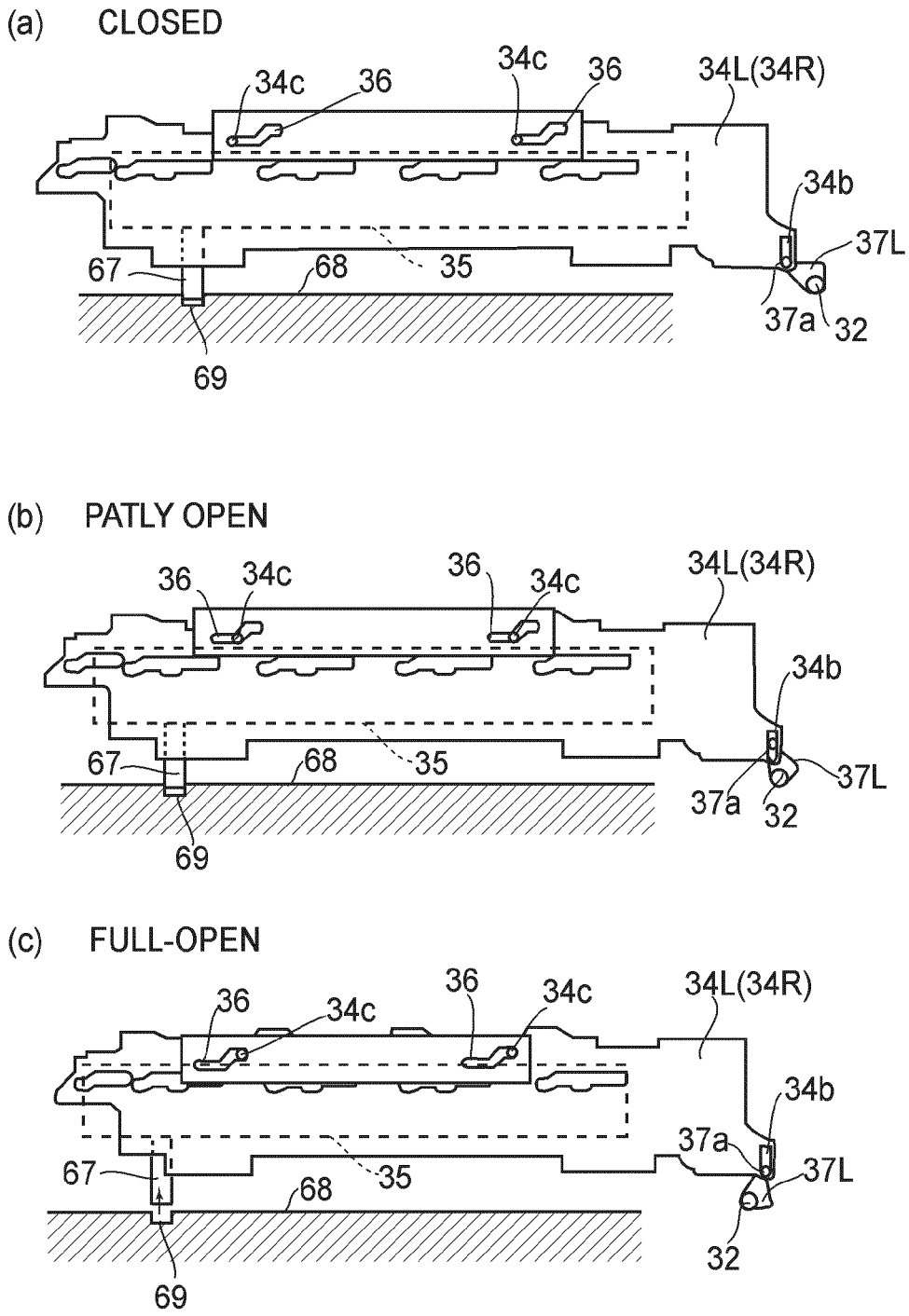
FIG. 11 is a schematic drawing showing the movement of the tray holding member, which is caused by the rotational door movement which occurs when the door is opened.

FIG. 11 shows the two pins 34*c* of the left holding member 34L, and the guiding slots 36 of the left frame 80L. It does not show the right holding member 34R. But, the right holding member 34R is the same as the left holding member 34L, except that its pins 34*c* and the corresponding guiding slots 36 of the left frame 80L are symmetrically positioned relative to those of the left holding members 34L and the corresponding guiding slots 36.

Therefore, the left and right holding members 34L and 34R are allowed to move relative to the left and right frames 80L and 80R, within the range set by the guiding slots 36.

Figure 12:
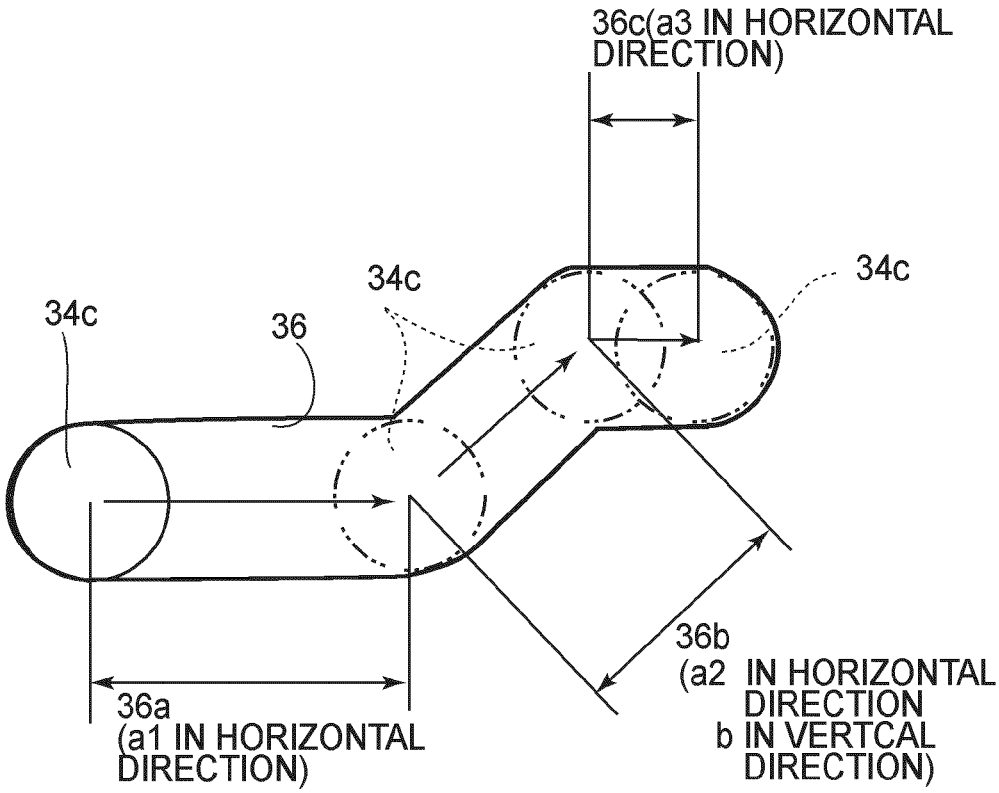
FIG. 12 is an enlarged view of the guiding slot.

FIG. 12 is an enlarged view of one of the guiding slots 36. Each guiding slot 36 is made up of first, second, and third guiding section 36*a*, 36*b*, and 36*c*. The first guiding section 36*a* horizontally extends in the fore-and-aft direction. The second guiding section 36*b* extends frontward from the front end of the first section 36*a*, in the diagonally upward direction. The third guiding section 36*c* horizontally extends frontward from the front end of the second guiding section 36*b*, being therefore positioned higher than the first guiding section 36*a*. The third guiding section 36*c* constitutes the section which catches and securely holds the pin 34*c*.

As the door 31 is opened, the pins 34*c* (and the holding members 34L and 34R) are moved a distance a1, by the opening movement of the door 31, while being horizontally guided by the first guiding section 36*a* of the guiding slot 36, and then, is moved slantingly upward (horizontally moved by distance a2 while being vertically moved by distance b) while being guided by the second guiding section 36*b*. Then, finally, they are horizontally moved a distance a3 while being guided by the third guiding section 36*c*.

FIG. 11(*a*) shows the state of the mechanical linkage between the door 31 and tray holding members 34L (R), in which the door 31 is completely shut against the apparatus main assembly. When the mechanical linkage is in this state, the left and right holding members 34L and 34R are in their rearmost positions in the apparatus main assembly. The holding members 34L and 34R remain supported by the apparatus main assembly with the presence of the hinge shaft 32, connective arms 37L and 37R, shafts 37*a*, and holes 34*b* between the door 31 and holding members 34L and 34R. Further, each pin 34*c* is located at the rear end of the first guiding section 36*a* of the guiding slot 36. Therefore, the holding members 34L and 34R are in their lowest levels (abovementioned second levels) relative to the left and right frames 80L and 80R, respectively. Therefore, the tray 35, which is remaining held by the holding members 34L and 34R, is also in its lowest level (abovementioned latent image formation position).

Each of the cartridges PY, PM, PC, and PK in the tray 35 is under the pressure applied to its left and right shoulder portions by the abovementioned pressing member. Thus, the bottom side (by which cartridge is accurately positioned) of the peripheral surface of the bearing 51, that is, the bearing on the drivable side, and the bottom side (by which cartridge is accurately positioned) of the peripheral surface of the bearing 52, that is, the bearing on the non-drivable side, are pressed upon the positioning portions 41 (FIGS. 14-14, and 24), one for one, with which the stays (internal panels) of the apparatus main assembly A is provided. Thus, each cartridge is accurately positioned and held relative to the apparatus main assembly A. Also, when the mechanical linkage is in the state described above, the downwardly facing area of the drum 1 in each cartridge reliably remains in contact with the outward surface of the top side of the belt of the belt unit 12.

The coupler 53 and 54 of each cartridge are in engagement with the drum driving coupler and development roller driving coupler, respectively, with which the apparatus main assembly is provided.

To the electrical contacts 55*a*-55*d* of each cartridge, electric power can be supplied from the apparatus main assembly through the corresponding electrical contacts 72*a*-72*d*.

The tray 35 is provided with a protrusion 67. An intermediary transfer belt supporting member 68, which is a stationary member of the apparatus main assembly, is provided with a hole 69. The protrusion 67 of the tray 35 is fitted in the hole 69, whereby the tray 35 is precisely positioned relative to the apparatus main assembly (FIGS. 11(*a*) and 12).

FIG. 11(*b*) shows the state of the mechanical linkage between the door 31 and the tray holding members 34L (34R), in which the door 31 is partially open. As the door 31, which is in the closed position as shown in FIG. 11(*a*), is opened, the holding members 34L and 34R are pulled frontward, in the apparatus main assembly, by the movement of the door 31. Therefore, first, the tray holding members 34L and 34R are horizontally moved frontward in the apparatus main assembly, by the distance a1, since the pins 34*c* of the holding members 34L and 34R are horizontally guided by the distance a1 by the first guiding section 36*a*. FIG. 11(*b*) shows the state of the mechanical linkage, in which the holding members 34L and 34R have just finished being horizontally moved frontward by the distance a1. While the left and right holding members 34L and 34R are moved by the distance a1 as described above, the drum driving coupler and development roller driving coupler of each cartridge are disengaged from the counterparts on the apparatus main assembly side, and also, the pressure applied to each cartridge by the pressing member to keep the cartridge precisely positioned is removed. However, the tip portion of the protrusion 67 remains in the hole 69, with which the stationary member 68 on the apparatus main assembly side is provided, remaining thereby precisely positioned, and therefore, preventing the tray 35 from following the movement of the holding members 34L and 34R.

As the door 31 is opened further, the holding members 34L and 34R are pulled further frontward by the rotational movement of the door 31, in the apparatus main assembly. Therefore, the holding members 34L and 34R move in the diagonally upward direction, with the pins 34*c* being guided by the second guiding section 36*b* of the guiding slot 36. During this slantingly upward movement of the holding members 34L and 34R, the electrical contacts 55 of each cartridge are electrically disconnected from the counterparts on the apparatus main assembly. That is, the intermediary electrical contacts 72*a*-72*d* become separated from the electrical contacts 75*a*-75*d* on the apparatus main assembly side, respectively, breaking thereby the electrical connection between the cartridge and apparatus main assembly.

Figure 13:
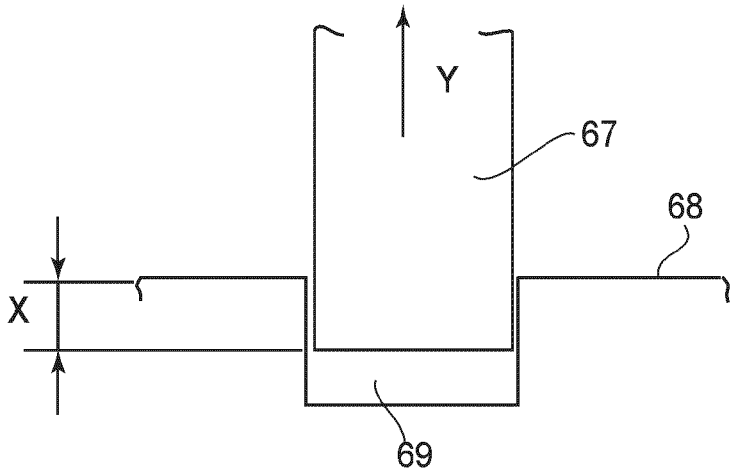
FIG. 13 is an enlarged view of the protrusion (pin) as a tray movement regulating means, and a hole (groove).

Referring to FIG. 13, a referential letter X stands for the distance by which the protrusion 67 enters the hole 69, and a referential letter Y stands for the distance by which the holding members 34L and 34R, which are holding the tray 35, are vertically displaced while they are moved frontward in the slantingly upward direction. During this slantingly upward movement of the holding members 34L and 34R, as long as the protrusion of the tray 35 remains in the hole 69 (X>Y), the protrusion 67 follows only the vertical component of the movement of the holding members 34L and 34R. Then, as the holding member 34L (34R) is displaced upward by a certain distance (X<Y), the protrusion 67 comes out of the hole 69. With the provision of the above described structural arrangement, as long as the downwardly facing area of the peripheral surface of the photosensitive drum 1 of each of the cartridges PY, PM, PC, and PK in the tray 35 is in contact with the belt 13, the tray 35 does not horizontally move. Therefore, the drum 1 is prevented from sustaining the scratches which are attributable to the rubbing of the peripheral surface of the photosensitive drum 1 by the belt 13, and/or from developing the memories which also are attributable to the above described rubbing.

FIG. 11(*c*) shows the state of the mechanical linkage, in which the door 31 is completely open. In this state, the holding members 34L and 34R have finished their slantingly upward movement effected by the second guiding section 36*b*, and therefore, the pins 34*c* are in the third guiding section 36*c*, which is horizontal. That is, the holding members 34L and 34R have been horizontally moved after they were moved slantingly upward. The reason for the provision of the above described structural arrangement is to keep the cartridges and holding members 34L and 34R steady in terms of the vertical direction, and also, to prevent the holding members 34L and 34R from shifting rearward when replacing the cartridge(s).

When the mechanical linkage is in the state shown in FIG. 11(*c*), the protrusion 67 has already come out of the hole 69, and therefore, the tray 35 is free from the positional restriction; in other words, the tray 35 can be horizontally moved (slid) relative to the holding members 34L and 34R in the fore-and-aft direction.

The above described protrusion 67 and hole 69 make up the cartridge movement regulating means which prevents the drum 1 in each cartridge, and the belt 13, from moving relative to each other in the direction intersectional to the direction in which the drum 1 comes into contact with the belt 13, when the tray 35, which is a movable member, is in the abovementioned preset position (image formation position) in the apparatus main assembly A. The restriction placed upon the tray 35 by this tray movement regulating means 67 and 69 to prevent the above described deviatory movement of the tray 35 is removed after the tray 35 is moved upward by the vertical component, that is, the component of the movement of the left and right tray holding members 34L and 34R, as the tray moving means, in the direction to separate the drum 1 from the belt 13.

The holding means 34L and 34R, which are the moving means, move (first movement), while being guided by the first guiding section 36*a*, in the direction intersectional to the direction in which the drum 1, which each cartridge has, comes into contact with the belt 13. This first movement is a linear movement. Next, the holding members 34L and 34R move (second movement) in the slantingly upward direction, that is, the direction having two directional components: the abovementioned separative direction, and the direction intersectional to the separative direction. The second movement is a downward movement. Thereafter, the holding members 34L and 34R move (third movement) in the direction intersectional to the direction in which the drum 1 and belt 13 come into contact with each other.

While the holding members 34L and 34R are making the first movement, the driving of the cartridges are ceased. Then, as the tray 35 follows the abovementioned movement of the holding members 34L and 34R in the direction to cause the drum 1 and belt 13 to separate from each other, the tray movement regulating means 67 and 69 are disengaged from each other. As the holding members 34L and 34R make the first to third movements, the tray 35 is made to linearly move in the horizontal direction, or diagonally upward (or downward) direction, by the movements of the holding members 34L and 34R.

For the improvement in usability, not only are the cartridges mounted in the movable member (tray) to make it easier for the cartridge(s) to be replaced, but also, the movable member (tray) is moved upward or downward by the vertical component of the movement of the moving means (tray holding members). Therefore, the employment of this embodiment makes it possible to make the intermediary electrical contacts 72*a*-72*d* come smoothly in contact with the electrical contacts 75*a*-75*d* on the apparatus main assembly side, respectively, without increasing the apparatus cost and main assembly size. Moreover, it can achieve the aforementioned object of providing an image forming apparatus which has a process cartridge drawer (tray), and yet, does not suffer from the problem that a photosensitive drum is scarred and/or develops memory by being rubbed by, or rubbing against, an intermediary transfer belt.

(Driving Force Transmitting Portion between Cartridge and Apparatus Main Assembly)

Figure 14:
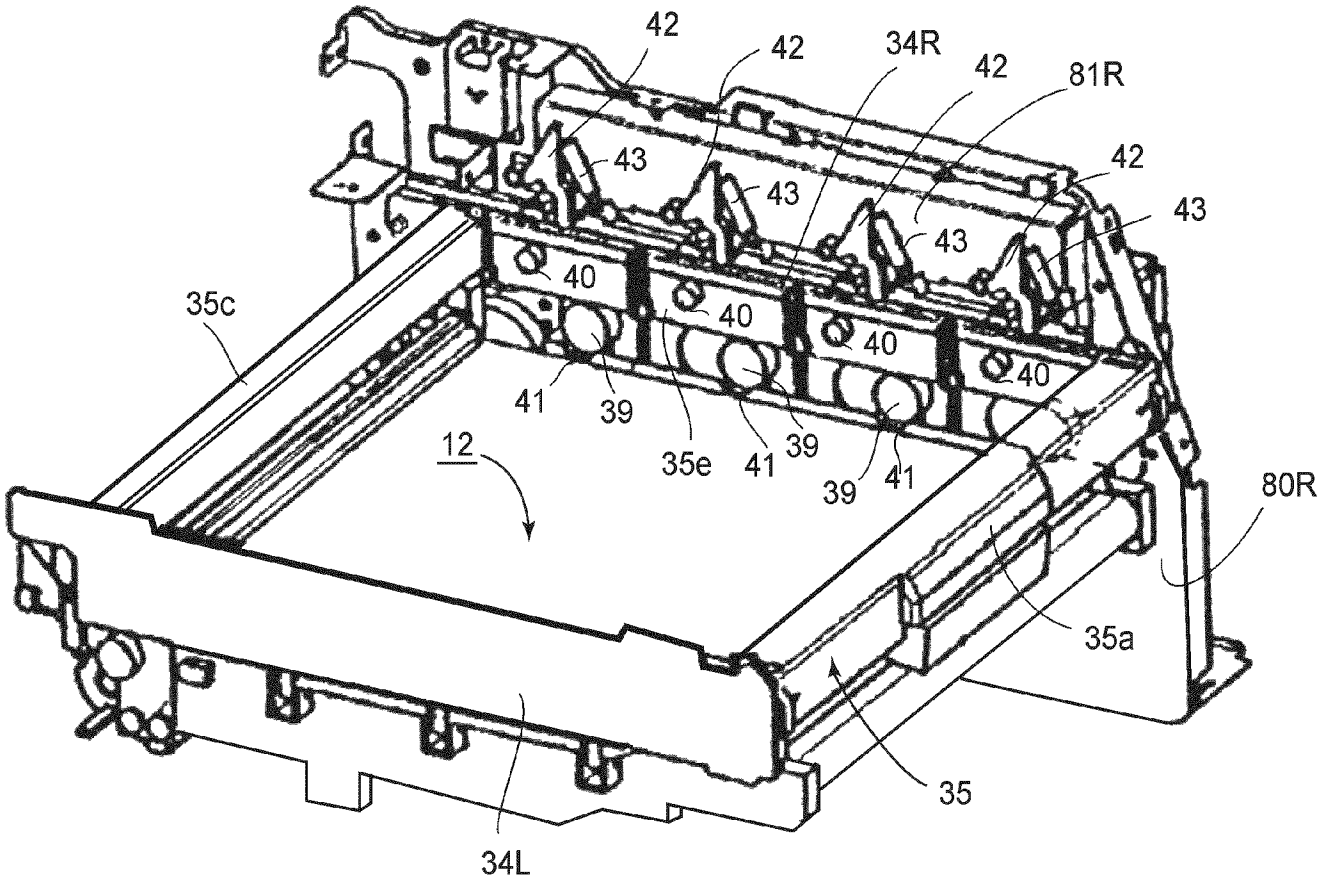
FIG. 14 is a perspective view (1) of the interfacial components and the portions thereof, which are located in the adjacencies of the cartridge bay, and are engaged or disengaged by the movement of the tray holding members.
Figure 15:
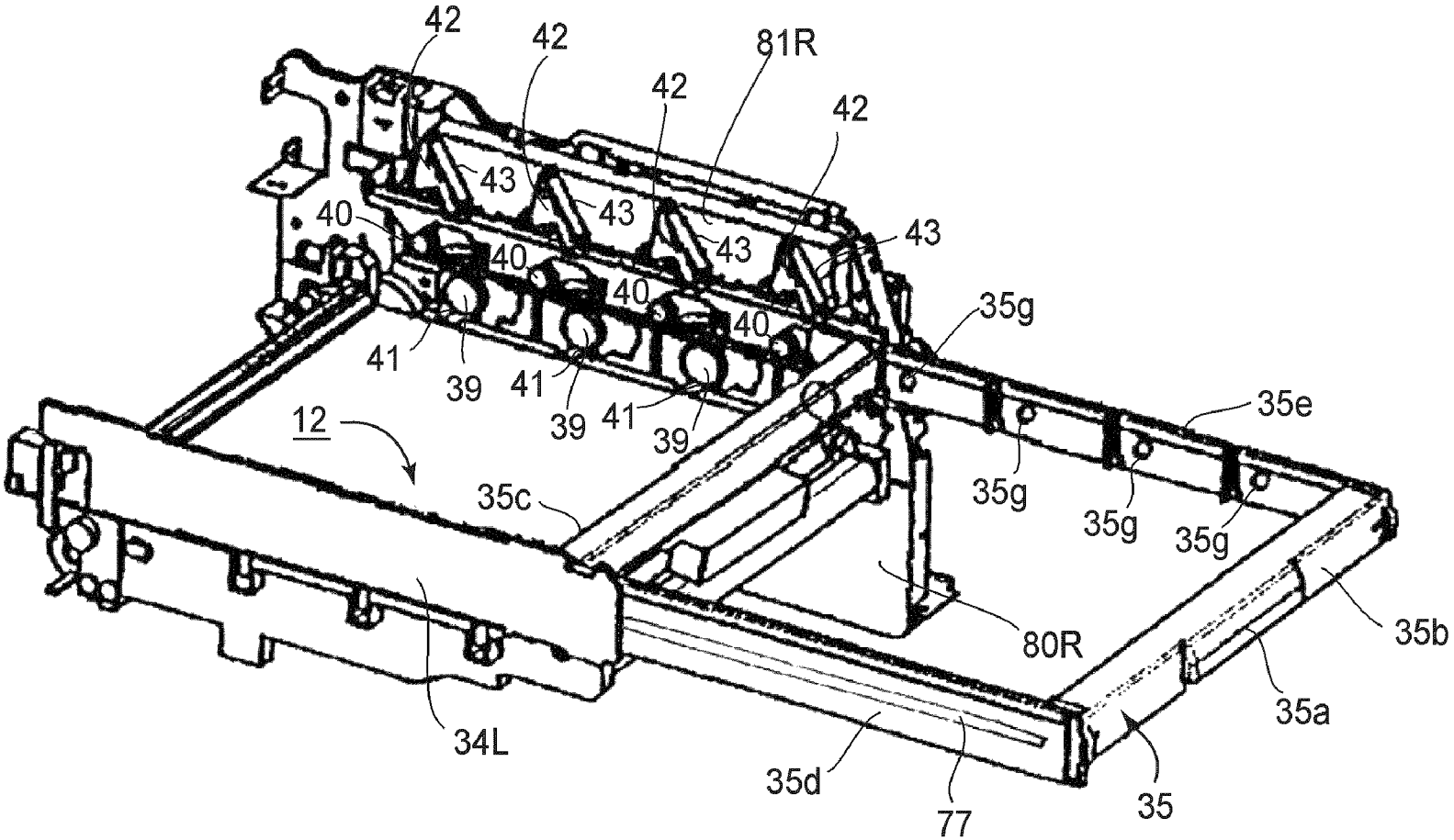
FIG. 15 is a perspective view (2) of the interfacial components and the portions thereof, which are located in the adjacencies of the cartridge bay, and are engaged or disengaged by the movement of the tray holding members.
Figure 16:
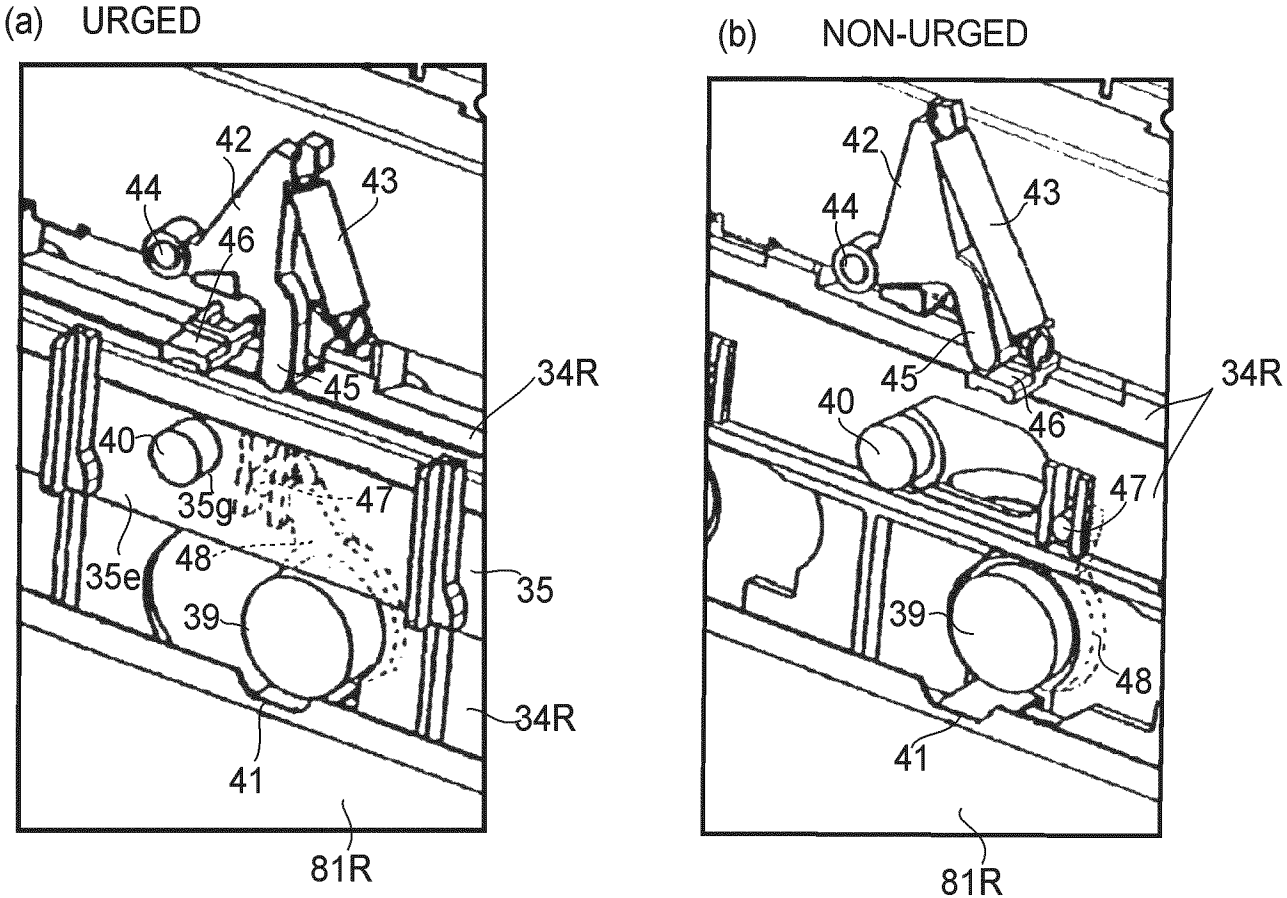
FIG. 16 is a perspective view (3) of the interfacial components and the portions thereof, which are located in the adjacencies of the cartridge bay, and are engaged or disengaged by the movement of the tray holding members.

FIGS. 14-16 are schematic drawings for describing the driving force transmitting components of each cartridge, which are engaged or disengaged by the movement of the tray holding members 34L and 34R, and their adjacencies.

FIG. 14 is a perspective view of, primarily, the holding members 34L and 34R, tray 35, and right frame 80R, which are in the state in which the door 31 is closed as shown in FIGS. 1 and 2, and no cartridge is in the tray 35. FIG. 15 is a perspective view of, primarily, the holding members 34L and 34R, tray 35, and right frame 80R, which are in the state in which the door 31 is open, and the tray 35 has been pulled out all the way.

On the right-hand side in the apparatus main assembly A, drum driving force transmission couplers 39 and development roller driving force transmission couplers 40 (which hereafter will be referred to simply as drum coupler and development roller coupler, respectively) are disposed. The drum coupler 39 and development roller coupler 40 constitute the driving force output portions on the apparatus main assembly side, and couple with the driving force input portions 53 and 54 (couplers) (FIG. 7) on the cartridge side. The drum coupler 39 and development roller coupler 40 transmit rotational driving force to the drum 1 and development roller 3*a*, respectively, in each cartridge.

Figure 24:
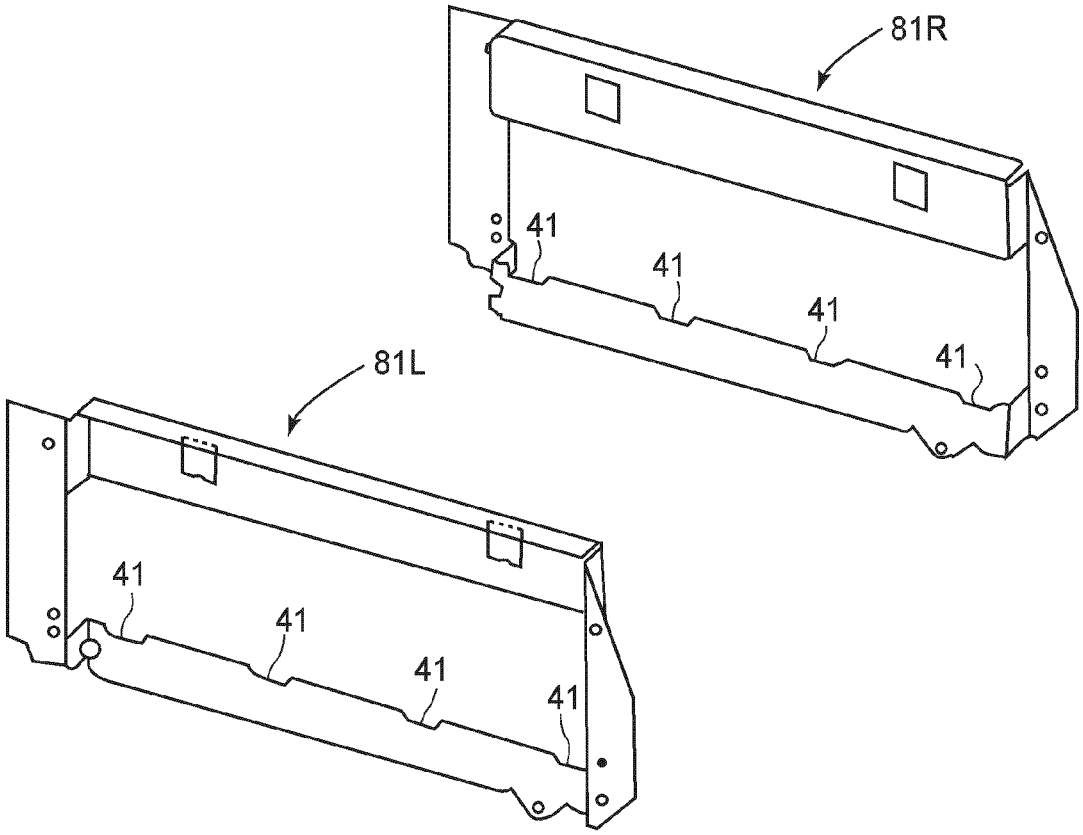
FIG. 24 is a perspective view of the left and right stays.

On both the left- and right-hand sides in the apparatus main assembly A, cartridge positioning portions 41 are located, which are parts of the left and right stays 81L and 81R of the apparatus main assembly A (FIG. 24). Each cartridge positioning portion 41 supports the corresponding bearing portions 51 (52), that is, the bearing portion on the drivable side (non-drivable side), by the downwardly facing portion of the peripheral surface of the cartridge bearing portion 51 (52).

Also on both the left and right sides in the apparatus main assembly, cartridge pressing members 42 are located, which are for keeping the cartridges secured in their preset positions (image forming position). More specifically, each cartridge pressing member 42 presses on the left and right end portions of the top surface of the corresponding cartridge to keep stable the bearing portion 51 (52), that is, the bearing portion on the drivable side (non-drivable side), supported by the abovementioned cartridge positioning portion 41. The pressing member 42 is provided with a spring 43 which generates the pressure to be applied by the pressing member 42.

FIG. 16(*a*) is an enlarged view of the pressing member 42, drum coupler 39, development roller coupler 40, and their adjacencies, which are in the state shown in FIG. 14. FIG. 16(*b*) is an enlarged view of the pressing member 42, drum coupler 39, development roller coupler 40, and their adjacencies, which are in the state shown in FIG. 15.

Each pressing member 42 is attached to the apparatus main assembly A so that it is rotatable about a pivot 44. The pressure generated by the abovementioned spring 43 is applied to the left (right) end portion of the top surface of the corresponding cartridge through the pressing lever portion 45 of the pressing member 42. When the pressing member 42 is in the state shown in FIG. 16(*b*), in which the pressing member 42 is not pressing the cartridge, the pressing lever portion 45 of the pressing member 44 has been pushed up by the pressing member raising portion 46 of the holding member 34R, being kept away from the cartridge. That is, the pressure applied to the cartridge has been removed by the movement of the tray holding member 34R.

A release ring 48 (decoupling means for decoupling couplers to prevent driving force from being transmitted to cartridge) is provided with a pin 47. The release ring 48 is fitted around the drum coupler 39 to retract the drum coupler 39. As the holding member 34R is moved, the release ring pin 47 is moved by the movement of the holding member 34R from the position shown in FIG. 16(*a*) to the position shown in FIG. 16(*b*), causing thereby the release ring 48 to move from the position shown in FIG. 16(*a*) to the position shown in FIG. 16(*b*). This movement of the release ring 48 causes the drum coupler 39 and development roller coupler 40 to retract to the positions shown in FIG. 16(*b*). That is, the drum coupler and development roller coupler of each cartridge are disengaged from the counterparts on the apparatus main assembly side.

FIG. 15 shows the states of the drum couplers 39, development roller couplers 40, and pressing members 42, and holding members 34L and 34R, in which the drum couplers 39 and development roller couplers 40 have been disengaged from the counterparts on the apparatus main assembly, by the movement of the holding members 34L and 34R, and the pressing members 42 have been disengaged from the cartridges by the movement of the holding members 34L and 34R. When the abovementioned components are in the states shown in FIG. 15, the tray 35 can be freely slid; the tray 35 can be moved in the direction to be pushed back into the apparatus main assembly, or in the direction to be pulled out of the apparatus main assembly.

As described above, the holding members 34R and 34L are moved by the opening or closing movement of the door 31. Thus, in order to reduce the amount of force necessary to open or close the door 31, it is desired that the image forming apparatus is structured so that the timing with which the abovementioned pressure is removed from the cartridges is slightly different from the timing with which the couplers are disengaged.

That is, the drum driving force transmission coupler 39, development roller driving force transmission coupler 40, and cartridge pressing member 42 are rendered slightly different in disengagement timing. More specifically, the release ring pin 47 and pressing member raising portion 46 are made different in position to render the drum coupler 39 and pressing member 43 slightly different in disengagement timing, and the four cartridges are rendered slightly different in the drum coupler disengagement timing and pressing member disengagement timing. The employment of this structural arrangement spreads across a preset span of time, the amount of the load which bears on the door 31, reducing thereby the peak load. Therefore, it can reduce the amount of force which a user has to apply to open or close the door 31.

As described above, in this embodiment, not only are the driving force transmitting means (coupler 39 and 40) retracted by the movement of the holding members 34R and 34L, but also, the tray 35 is vertically moved by the movement of the holding members 34R and 34L. That is, the role of disengaging the driving force transmitting means and the role of vertically moving the tray 35 are carried out by the same mechanism, contributing to the reduction of the apparatus main assembly size.

(Tray Position Regulating Means)

Figure 17:
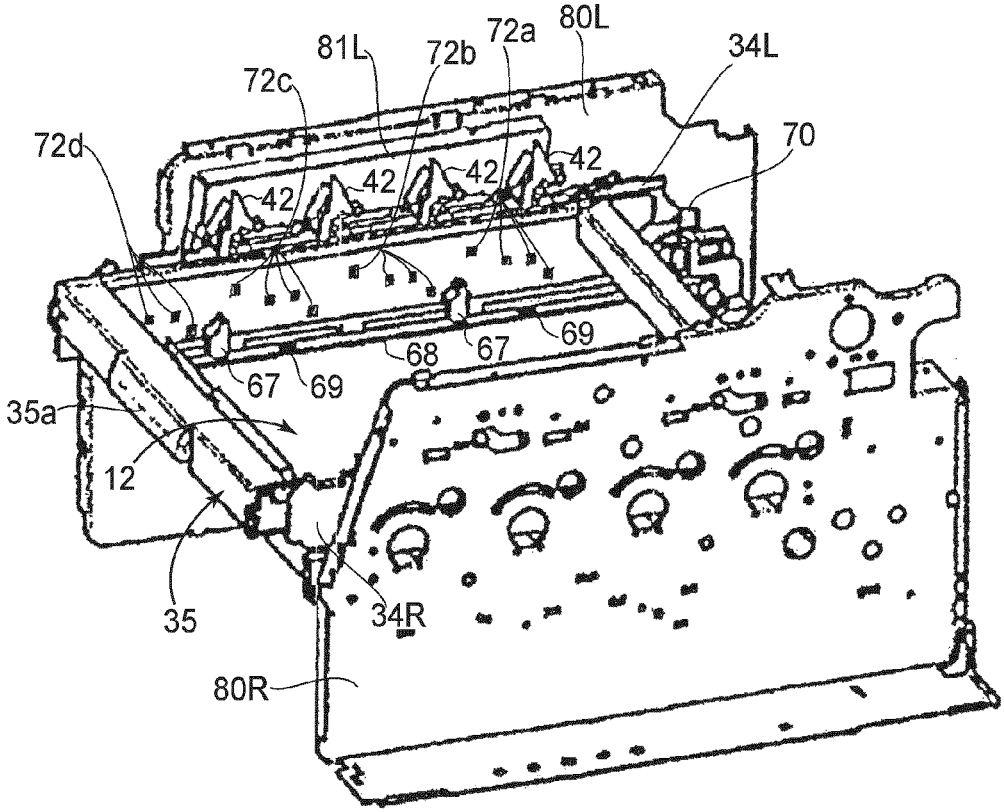
FIG. 17 is a drawing (1) showing the tray position regulating means.
Figure 18:
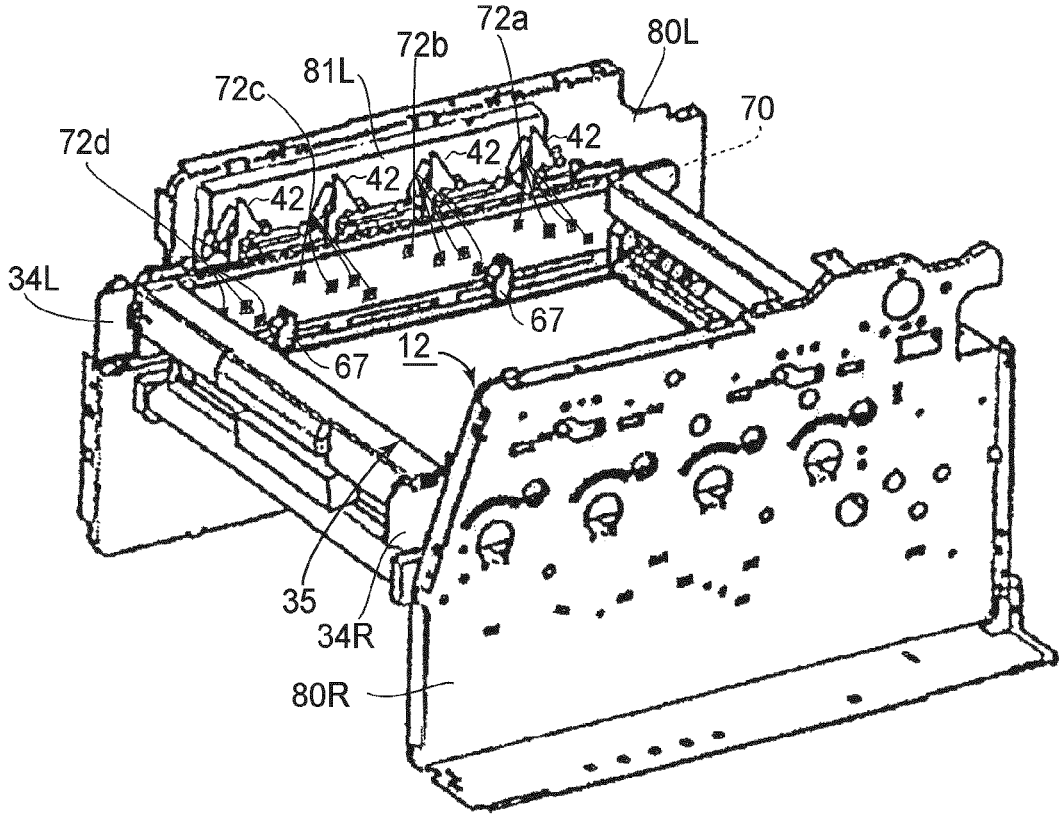
FIG. 18 is a drawing (2) showing the tray position regulating means.
Figure 19:
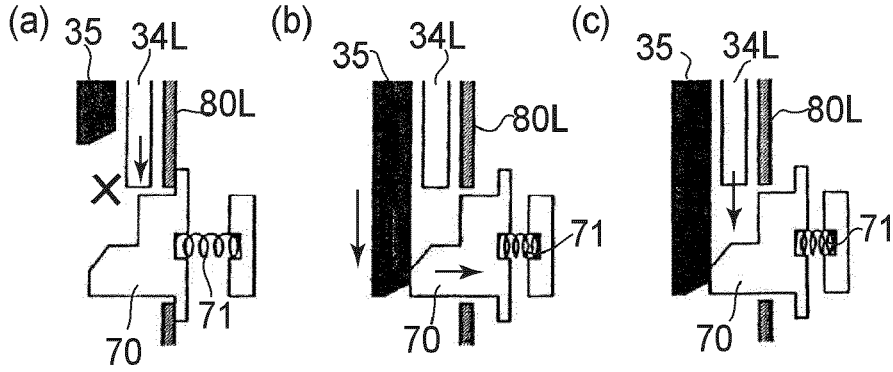
FIG. 19 is a drawing (3) showing the tray position regulating means.

FIG. 17 shows the states of the holding members 34R and 34L, tray 35, and their adjacencies, in which the holding members 34R and 34L and tray 35 are in their topmost positions, into which they were pushed up by the opening movement of the door 31, and the tray 35 is not completely in the apparatus main assembly. FIG. 18 shows the states of the holding members 34R and 34L, tray 35, and their adjacencies, in which the tray 35 has been pushed back into the apparatus main assembly as far as possible. FIG. 19 is a schematic drawing showing the movement of the cartridge position regulating means disposed in the left rear portion in the apparatus main assembly.

If the door 31 is closed when the tray 35 is in the state shown in FIG. 17, in which the tray 35 has not been pushed back as far as possible, the rear end of the holding member 34R (34L) strikes a stopper 70 (first regulating member), as shown in FIG. 19(*a*), while the holding member 34R (34L) is moved into the apparatus main assembly by the movement of the door 31. Therefore, the door 31 cannot be closed further to move the holding member 34R (34L) further rearward into the apparatus main assembly in the diagonally downward direction. However, the tray 35 can be pushed back into the apparatus main assembly. At this point, therefore, the tray 35 is to be push inward of the apparatus main assembly so that the tray 35 will be completely pushed back into the apparatus main assembly as shown in FIG. 18. As the tray 35 is pushed inward of the apparatus main assembly, the rear end of the tray 35 (which constitutes first releasing member which disengages first regulating member) comes into contact with the stopper 70, and moves the stopper 70 from the regulating position to the releasing position against the resiliency of the spring 71, as shown in FIG. 19(*b*). When the tray 35 is in the position shown in FIG. 18 (FIG. 19(*b*)), the stopper 70 does not interfere with the rear end of the holding member 34R (34L) when the holding member 34R is moved rearward by the closing movement of the door 31. In FIG. 19(*b*), the stopper 70 is in the position in which it allows the door 31 to be closed, allowing therefore the holding member 34R to be moved rearward, indicated by an arrow mark in FIG. 19(*c*). Therefore, the door 31 can be closed all the way to rearwardly move the holding members 34R and 34L and tray 35 in the diagonally downward direction.

That is, while the tray 35 is in a position which is away from the transitional position in the apparatus main assembly, the stopper 70 prevents the door 31 from moving from the open position to the closed position. Further, as the tray 35, which is the first releasing member, is moved into the transitional position in the apparatus main assembly A, it removes the restriction which the stopper 70 places upon the movement of the holding member 34R. That is, the tray 35 removes the restriction which the stopper 70 places, allowing thereby the door 31 to move from the open position to the closed position.

In this embodiment, the cartridges can be easily replaced from the front side of the apparatus main assembly. More specifically, the image forming apparatus is provided with a cartridge tray (drawer), in which the cartridges are placed. When the cartridges are mounted into the apparatus main assembly, they are accurately positioned relative to the apparatus main assembly by the components on the apparatus main assembly side. The drawer (tray) loosely holds the cartridges, and is movable between the outermost position and the image formation position in the apparatus main assembly. Therefore, all that is necessary for a user to do in order to ensure that a cartridge, or cartridges, are precisely positioned in the image formation position in the apparatus main assembly, when the user mount the cartridge(s) or replace the cartridge(s) in the apparatus main assembly is for the user to place the cartridge(s) in the cartridge tray (drawer) from directly above the tray, push the tray 35 into the image formation position (cartridge placement second space 200), and then, close the door 31. In other words, this embodiment makes it possible to provide an image forming apparatus which is simple in the operation which must be carried out by the user to mount a cartridge into the apparatus main assembly, or replace a cartridge in the apparatus main assembly, and yet, ensures that as a cartridge is mounted into the apparatus main assembly, it is precisely positioned relative to the apparatus main assembly.

In this embodiment, however, the image forming apparatus is provided with the member which regulates the movement of the door 31 in coordination with the positioning of the tray 35, and/or the member which regulates the movement of the tray in coordination with the opening or closing movement of the door 31, so that unless the door 31 is fully opened, the tray 35 cannot be moved, or so that unless the tray 35 is completely pushed back into the apparatus main assembly, the door 31 cannot be closed. Therefore, a user is prevented from making operational errors. That is, it does not occur that the tray 35 is operated when the tray 35 is not in its topmost position. Therefore, it does not occur that the drum 1 is rubbed by the belt.

Incidentally, the above described combination of the protrusion 67 and hole 69 (FIGS. 11 and 13) can be utilized as the substitute for the stopper 70 for the tray 35. This setup will be described next, with reference to FIGS. 17, 18, and 19.

When the tray 35 is in the state shown in FIG. 17, in which the tray has not been completely pushed back into the apparatus main assembly, the protrusion 67 of the tray 35 is not in alignment with the hole 69 of the intermediary transfer belt supporting member 68 (stationary member). If an attempt is made to close the door 31 when the tray 35 is in this state, the holding members 34R and 34L are lowered by the closing movement of the door 31, through the connective arms 37R and 37L, and therefore, the tray 35 is lowered. However, the protrusion 67 strikes the intermediary transfer belt supporting member 68, preventing thereby the door 31 from being closed.

Figure 20:
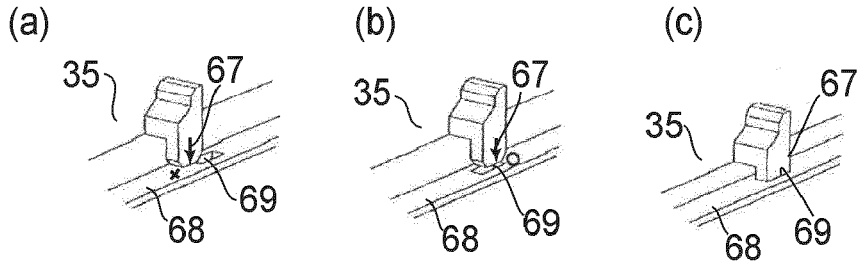
FIG. 20 is a drawing (4) showing the tray position regulating means.

On the other hand, if the tray 35 is lowered when the tray 35 is in the state shown in FIG. 18, in which it has been completely pushed back into the apparatus main assembly, the protrusion 67 enters the hole 69 as shown in FIGS. 20(*b*) and 20(*c*). Therefore, the door 31 can be closed to lower the tray holding members 34R and 34L to lower the tray 35.

Therefore, the tray 35 can be lowered only when the tray 35 is in the transitional position in the apparatus main assembly, in terms of the horizontal direction of the apparatus main assembly A. Therefore, each cartridge is precisely positioned by the cartridge positioning portion 41.

Referring to FIGS. 17 and 18, in this embodiment, each of the left and right sections of the primary frame of the tray 35 is provided with two protrusions 67 which are the same in shape, and each of the left and right end portions of the intermediary transfer belt holding member 68 is provided with two hole 69 which are the same in shape. However, the number and shape of the protrusions 67 and holes 69 do not need to be as shown in FIGS. 17, 18, and 20. Further, when two or more protrusions and holes are provided, they do not need to be the same in shape. Further, the manner in which each protrusion 67 fits into the corresponding hole 69 does not need to be exactly as shown in FIGS. 17, 18, and 20. Moreover, the hole 69 does not need to be a part of the intermediary transfer belt supporting member.

(Structural Arrangement for Supplying Cartridge with Power)

Figure 22:
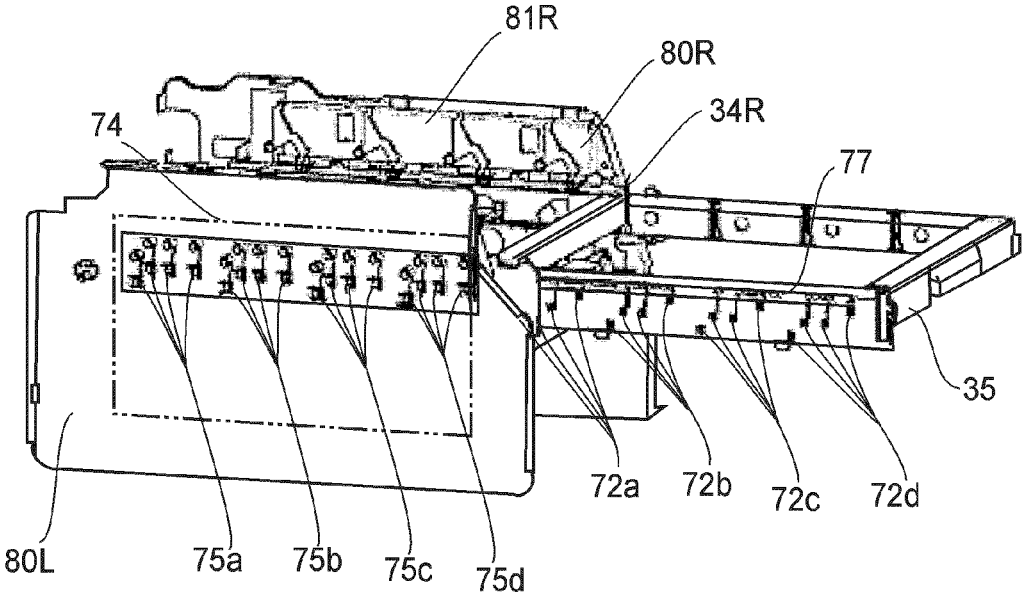
FIG. 22 is a drawing (2) showing the means for supplying electric power to a cartridge.
Figure 23:
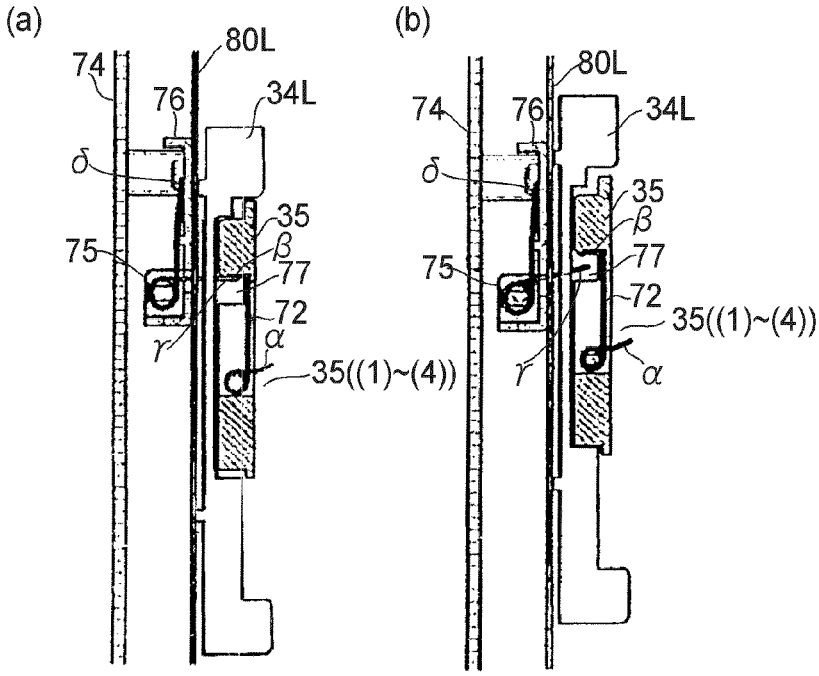
FIG. 23 is a drawing (3) showing the means for supplying electric power to a cartridge.

FIGS. 21-23 are drawings for describing the method for supplying electric power to each cartridge from the apparatus main assembly.

FIGS. 21 and 22 show the state of the tray 35, tray holding members 34R and 34L, and their adjacencies, in which the tray 35 has been pulled out all the way by the opening of the door 31. The tray 35 is provided with multiple sets 72*a*-72*d* of electrical contacts, which are aligned in the direction parallel to the horizontal direction, and also, vertical direction, of the apparatus main assembly A. Each electrical contact 72 is formed of an electrically conductive substance, and is in the form of a spring. Referring to FIG. 23, each electrical contact 72 is provided with a first electrical contact point α, which is on the inward side of the tray 35, and a second electrical contact point β, which is on the outward side of the tray 35. The first electrical contact point a is electrically connectible to the electrical contact point 55 on the cartridge side.

When the cartridge is in the tray 35, being thereby supported by the tray 35, the first electrical contact point a is in contact with the electrical contact point 55 on the cartridge side, and therefore, there is electrical connection between the cartridge and tray 35. The first electrical contact point α is elastic, and protrudes slight into the corresponding cartridge bay (35(1)-35(4)) of the tray 35. Therefore, while the cartridge settles into one of the abovementioned cartridge bays 35(1)-35(4) after it is released by a user, the first electrical contact point α elastically deforms as it comes into contact with the electrical contact 55 on the cartridge side. Therefore, the first electrical contact point α smoothly connects with the electrical contact 55 on the cartridge side.

The apparatus main assembly is provided with multiple sets 75*a*-75*d* of electrical contacts, which are on the inward side of the apparatus main assembly, being aligned along the path of the tray 35. More specifically, each electrical contact 75 is formed of an electrically conductive elastic substance, and is in the form of a spring. It is electrically connected to the electrical power supply portion 74 on the apparatus main assembly side, which is located outside the left frame 80L, that is, the left section of the main frame of the apparatus main assembly. The multiple sets 75*a*-75*d* of the electrical contacts are aligned in the horizontal direction, and also, vertical direction, of the apparatus main assembly. Each electrical contact 75 protrudes toward the tray 35 through the hole with which the left frame 80L is provided, and the hole with which the left holding member 34L is provided. The abovementioned second electrical contact point β of the electrical contact 72 is electrically connectible to this electrical contact 75 on the apparatus main assembly side.

FIGS. 23(*a*) and 23(*b*) show how the electrical contact 72, with which the tray 35 is provided, is electrically connected to, or disconnected from, the electrical contact 75 on the apparatus main assembly side. FIGS. 23(*a*) and 23(*b*) show the same portions of a sectional view of the tray 35, electrical contact 72, left tray holding member 34L, left frame 80L, electrical contact 75 on the apparatus main assembly side, electrical contact holder 76 on the apparatus main assembly side, and power supply portion 74 on the apparatus main assembly side, as seen from the front side of the apparatus main assembly.

FIG. 23(*a*) shows the state of the abovementioned components, in which the door 31 is in the closed position, and the left tray holding member 34L and tray 35 are in their image formation positions, into which they have been lowered, in the apparatus main assembly. When they are in this state, the electrical contact 75 on the apparatus main assembly side is electrically in contact with the electrical contact 72.

FIG. 23(*b*) shows the state of the abovementioned components, in which the door 31 is in the open position, and the left tray holding member 34L and tray 35 are at their top levels to which they have been raised from the image formation positions in the apparatus main assembly. When they are in this state, there is no electrical connection between the electrical contact 75 on the apparatus main assembly side and the second electrical contact point β of the electrical contact spring 72. In order to prevent the tray 35 from contacting the portion γ of the electrical contact 75 on the apparatus main assembly, which is protruding toward the tray 35 beyond the holding member 34L, the tray 35 is provided with a space (groove) 77 which extends in the fore-and-aft direction of the apparatus main assembly. Therefore, the tray 35 can be pulled out without coming in contact with the electrical contact 75 of the apparatus main assembly.

The second electrical contact point β of the electrical contact 72 is above the space 77.

The abovementioned space 77 is located between the tray 35 and the electrical contact 75 on the main assembly side, preventing thereby the tray 35 from coming into contact with the electrical contact 75 on the apparatus main assembly side while the tray 35 is moved from inside the apparatus main assembly to the outside of the apparatus main assembly. The second electrical contact point β of the electrical contact 72 becomes electrically connected with the end portion (extending portion) γ of the electrical contact 75 on the apparatus main assembly side, which is inwardly protruding toward the tray 35, while the tray 35 is moved downward after it is horizontally moved into the apparatus main assembly from outside the apparatus main assembly.

The top end of the main assembly electrical contact 75 constitutes a fixation point δ. The abovementioned horizontal movement of the tray 35 into the apparatus main assembly from outside the apparatus main assembly causes the extending portion γ of the electrical contact 75 to enter the space 77 (groove) of the tray 35. Then, while the tray 35 is moved downward, the extending portion γ comes into contact with the second electrical contact points β of the electrical contact 72, being thereby elastically deformed.

More specifically, the apparatus main assembly is provided with electrical contacts 75*a*-75*d*, which are disposed so that their positions do not coincide with the path of the intermediary electrical contacts 72*a*-72*d* of the tray 35. The apparatus main assembly is structured so that the electrical connection between the electrical contacts of the cartridges and corresponding electrical contacts of the apparatus main assembly can be broken by moving upward (raising) the tray 35 from the preset position (image formation position) by the holding members 34L and 34R, or can be established by moving downward (lowering) the tray 35 toward its image formation position by the holding members 34L and 34R.

In this embodiment, the apparatus main assembly has: an electrical contact c for supplying the charge roller 2 with the charge bias for charging the drum 1; an electrical contact a for supplying the development roller 3*a* with the development bias for developing the electrostatic latent image formed on the drum 1; an electrical contact d for supplying the developer supply member (unshown) with the supply bias; and an electrical contact b for supplying the developer regulating member (unshown) with regulation bias. The cartridge has: the electrical contact c which contacts the charge bias contact c of the apparatus main assembly; an electrical contact a which contacts the development bias contact a of the apparatus main assembly; an electrical contact d which contacts the supply bias contact d of the apparatus main assembly; and an electrical contact b which contacts the electrical contact b of the apparatus main assembly.

Incidentally, the shape of the electrical contact 75, shape of the electrical contact 72, and the direction of the contact pressure in each electrical junction, do not need to be as shown in FIGS. 21-23.

FIGS. 21 and 23 show the method for supplying the set of electric power receiving contacts of each cartridge, with electric power, with the use of the single springy electrical contact of the apparatus main assembly, and the single springy intermediary electrical contact. However, the present invention is also useful even if each cartridge is provided with two or more portions through which it receives electric power. Further, the present invention is also useful even if the abovementioned two or more portions, through which each cartridge receives electric power, are different in position in terms of the vertical direction of the apparatus main assembly; the apparatus main assembly is provided with multiple springy electrical contacts, which are different in the position in terms of the vertical direction, and the tray 35 is provided with multiple grooves, which match the springy electrical contacts of the apparatus main assembly, in the position in terms of the vertical direction of the apparatus main assembly.

As described above, in this embodiment, the process cartridges are mounted in the movable member (tray) so that the process cartridge or process cartridges can be replaced from the front side of the apparatus main assembly. Further, the movable member is provided with the intermediary electrical contacts, and the electrical contact between each process cartridge and the apparatus main assembly is established or broken by the vertical movement of the movable member. Therefore, the image forming apparatus in this embodiment, which employs a cartridge drawer, which makes it easier to replace the cartridge or cartridges, is no higher in cost and no greater in main assembly size than an image forming apparatus in accordance with the prior art, which employs a cartridge drawer.

Also in this embodiment, the movable member is moved upward or downward by the movement of the member which exposes or covers the cartridge replacement opening of the apparatus main assembly. Therefore, the cartridge or cartridges can be replaced through a cartridge replacement sequence, which can be easily predictable by a user.

Also in this embodiment, multiple sets of electrical contacts are horizontally arranged in a straight line so that the corresponding electrical contacts in the multiple sets of electrical contacts are positioned at the same level. Therefore, the amount of space, which the apparatus main assembly in this embodiment requires for the electrical contacts in terms of the vertical direction is significantly smaller than that, which the apparatus main assembly in accordance with the prior art requires. Therefore, the image forming apparatus in this embodiment is substantially smaller in the size of the main assembly than an image forming apparatus in accordance with the prior art, which employs a cartridge drawer.

The tray 35 is movable in the direction intersectional (perpendicular) to the lengthwise direction of the electrophotographic photosensitive drum of each process cartridge, while holding multiple process cartridges. Further, it can moved into, or out of, the apparatus main assembly A, while holding multiple process cartridges.

Further, the electrical contacts 75 are positioned inside the apparatus main assembly A, and aligned along the path of the tray 35.

Further, each electrical contact 75 is provided with the first and second electrical contact points α and β. The first and second electrical contact points α and β are attached to the tray 35. The first electrical contact point α is positioned inside the tray 35, whereas the second electrical contact point β is positioned outside the tray 35. The first electrical contact point α makes electrical contact with the electrical contact 55 of the cartridge, and the second electrical contact point β makes electrical contact with the electrical contact 75.

Further, the space 77 is provided between the tray 35 and electrical contacts 75 to prevent the tray 35 from coming into contact with the electrical contacts 75 with which the apparatus main assembly A is provided. In this embodiment, the space 77 is provided on the outward side of the frame section 35*d* (lateral plate) of the tray 35, and faces the electrical contacts 75. More concretely, the space 77 is provided by providing the outward side of the frame section 35*d* (lateral plate) of the tray 35 with a groove which extends in the direction parallel to the moving direction of the tray 35. In this embodiment, the space 77, or groove 77, is in the bottom side of the path of the tray 35.

The tray 35 is linearly moved into the apparatus main assembly A from outside, and then is moved diagonally downward. This downward movement of the tray 35 establishes electrical connection between the second electrical contact point β and electrical contact 75.

Therefore, the structural arrangement, in this embodiment, for supplying the cartridges with power, ensures that the electrical contacts 55 of the cartridges make contact with the electrical contacts 75, even through multiple cartridges are supported side by side in the tray 35 which is linearly movable relative to the apparatus main assembly A.

Incidentally, the second electrical contact point β is separated from the electrical contact 75 of the apparatus main assembly by the tray movement which occurs as the tray 35 is moved out of the apparatus main assembly A from the image formation position in the apparatus main assembly A, and which is opposite in direction from the above described inward tray movement.

Further, in the case of the structural arrangement, in this embodiment, for supplying the cartridges with power, as the tray 35 is moved into the apparatus main assembly A from outside, the tip γ (tip of one of straight end portions) of the electrical contact 75 (*a, b,* and *c*) enters the space 77 (groove). Then, while the tray 35 is moved diagonally downward after the abovementioned linear inward movement, the tip γ comes into contact, and remains in contact, with the second electrical contact point β (a, b, and c), which is in the top portion of the space 77 (groove) (FIGS. 23(*a*) and 23(*b*)).

Further, the tip γ of the electrical contact 75(*d*) is in the space 77, which is in the bottom portion of the path of the tray 35. Then, while the tray 35 is moved downward after its inward linear movement described above, the tip γ of comes into contact, and remains in contact, with the second electrical contact point β (d) (unshown), which is on the top surface (which is next to bottom surface of tray 35) of the space 77.

Therefore, the structural arrangement, in this embodiment, for supplying the cartridges with power ensures that the electrical contacts 55 (a, b, c, and d) of the process cartridges smoothly come into contact with the electrical contacts 75 (a, b, c, and d) of the apparatus main assembly, respectively.

In the preferred embodiment of the present invention described above, the image forming apparatus was structured so that the tray 35 is linearly movable in the direction parallel to the surface on which the apparatus main assembly A is placed. However, the preferred embodiment is not intended to limit the present invention in scope. For example, the present invention is also applicable to an image forming apparatus structured so that the tray 35 is linearly moved out of the apparatus main assembly A in the diagonally upward direction, and is linearly moved into the apparatus main assembly A in the diagonally downward direction, or so that the tray 35 movable in the linearly moved out of the apparatus main assembly A in the diagonally downward direction, and is linearly moved into the apparatus main assembly A in the diagonally upward direction. Obviously, such an image forming apparatus has to be also structured so that the tray 35 is moved downward after being linearly moved into the apparatus main assembly.

FIGS. 9A-9D show the structural features of an image forming apparatus, which characterize the present invention.

In this embodiment, the tray 35 is provided with an electrically conductive common member 78, which is shared by the multiple cartridges in the tray 35. The electrically conductive common member 78 is attached to the lengthwise end of the tray 35, in terms of the lengthwise direction of the drum 1 in each of the cartridges held side by side in parallel in the tray 35. The electrically conductive common member 78 is a long and narrow piece of electrically conductive metallic plate, and is attached to the end of the tray 35, in terms of the direction perpendicular to the direction in which the tray 35 formed of an electrically nonconductive resin is movable. The electrically conductive common member 78 is attached to the abovementioned end of the tray 35 in such a manner that it straddles the top end (surface) of the abovementioned end of the tray 35. In this embodiment, this electrically conductive common member 78, or the log and narrow piece of metallic plate, is shaped like a channel iron having a U-shaped cross section, and is positioned so that its open side faces downward. It is attached to the top end of the left section 35*d* of the frame of the tray 35 in such a manner that it straddles the top end of the left section 35*d*. The electrically conductive common member 78, that is, the piece of metallic plate, in this embodiment is formed of galvanized sheet iron (SECC).

The tray 35 is an electrically nonconductive component, whereas the electrically conductive common member 78 is an electrically conductive component. Incidentally, the tray 35 may be made up of electrically conductive components. In the case in which the tray 35 is made up of electrically conductive components, the electrically conductive common member 78 and the other electrical contacts are to be attached to the tray 35 with the interposition of an electrically nonconductive member between the tray 35 and each of the electrically conductive members.

The tray 35 is provided with four cartridge supporting portions 35Y, 35M, 35C, and 35K, in which the first to fourth cartridge PY, PM, PC, and PK are supported. Further, the tray 35 is provided with four electrical contacts 72, which are positioned so that they make electrical contact with the four electrical contacts 55, one for one, which the first to fourth cartridges PY, PM, PC, and PK have one for one. Further, the electrical contacts 72 are electrically in connection to the electrically conductive common member 78.

In order to supply each cartridge in the tray 35 with electric power at least when the tray 35 is in its image formation position, the apparatus main assembly A is provided with the electrical contact 75 (springy electrical contact), which remains in contact with the electrically conductive common member 78 when the tray 35 is in its image formation position.

Thus, when the cartridges PY, PM, PC, and PK are in their image formation positions in the apparatus main assembly A, electric power is supplied to the processing means of each cartridge from the apparatus main assembly A, through the electrical contact 75 of the apparatus main assembly A, the electrically conductive common member 78 of the tray 35, and the electrical contacts of each cartridge. An example of the processing means of each cartridge, which receive electric power through the electrical contact 75 of the apparatus main assembly A, the electrically conductive common member 78 of the tray 35, and the electrical contacts of each cartridge, is the charge roller 2 which charges the drum 1.

The employment of the above described structural arrangement for supplying the cartridges with electric power makes it possible to reduce the number of electrical junctions between the cartridges and apparatus main assembly A, and therefore, it can ensure, without increasing component count, that the electrical contacts of each cartridge are connected to the electrical contacts of the apparatus main assembly A.

The electric power can also be supplied to the development roller 3*a*, developer regulating member, developer supplying member, etc., with the use of electrical conductive common member similar to the above described electrically conductive common member 78.

The electrical contacts 75 and electrically conductive common member 78 are connected or disconnected by the movement of the downward or upward movement of the electrically conductive common member 78, which is caused by the downward or upward movement of the tray 35.

Figure 9B:
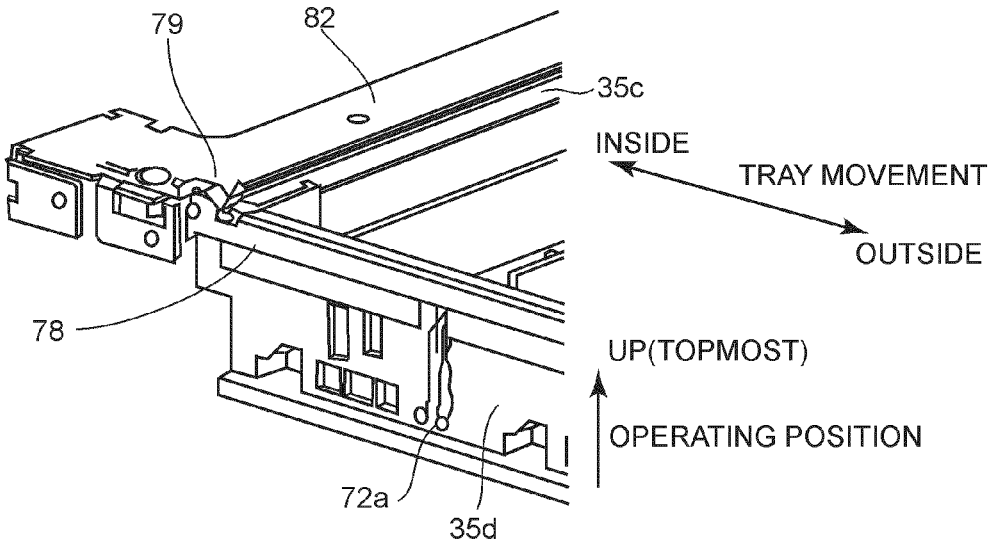
FIG. 9B is a perspective view of the ground contact of the apparatus main assembly, the intermediary electrical contact (which also doubles as tray reinforcing member) on the tray, and the left front corner portion of the tray in terms of the inward movement of the tray, when the ground contact is in contact with the intermediary electrical contact.
Figure 9C:
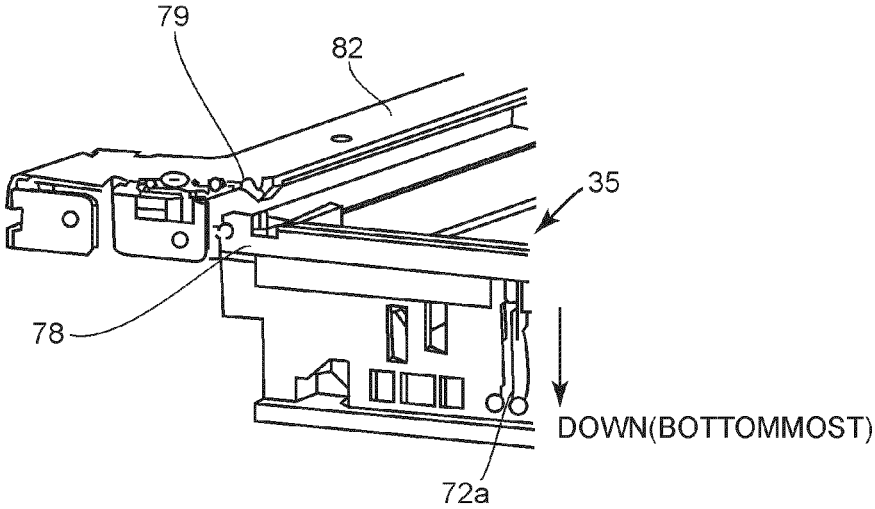
FIG. 9C is a perspective view of the ground contact of the apparatus main assembly, the intermediary electrical contact (which also doubles as tray reinforcing member) on the tray, and the left front corner portion of the tray in terms of the inward movement of the tray, when the ground contact is not in contact with the intermediary electrical contact.
Figure 9D:
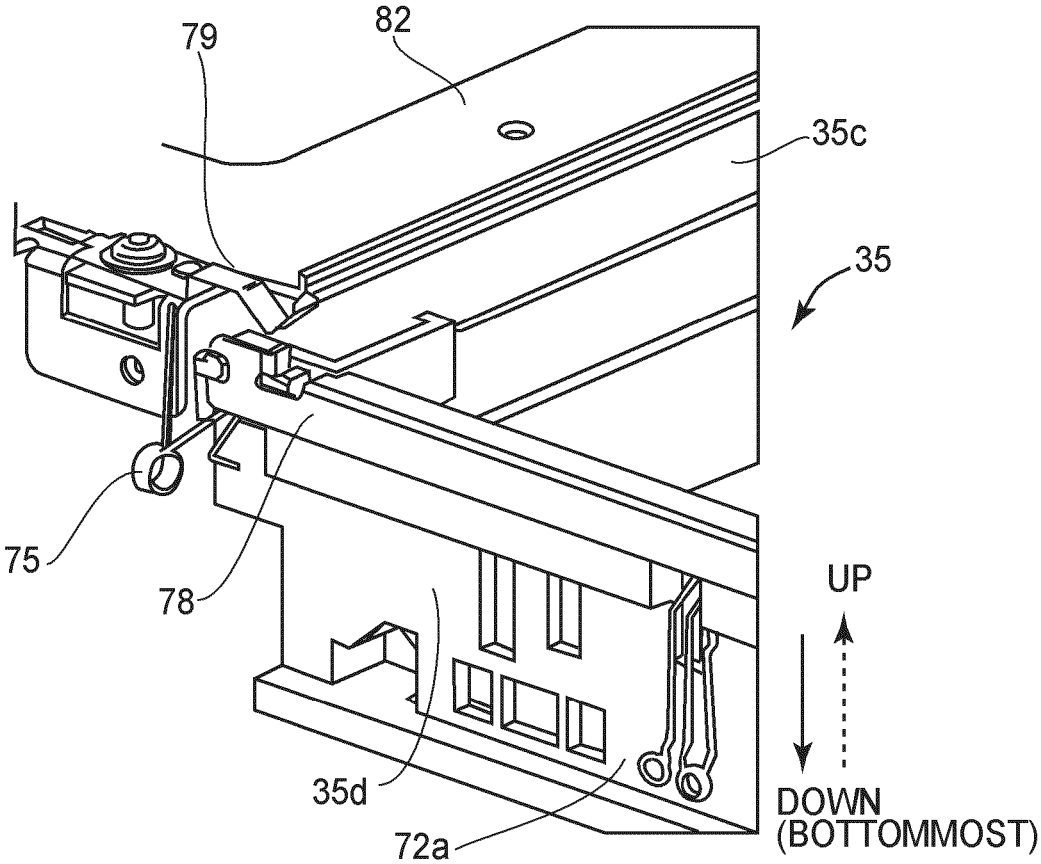
FIG. 9D is a perspective view of the electrical contact on the main assembly side, the ground contact of the apparatus main assembly, the intermediary electrical contact (which also doubles as tray reinforcing member) on the tray, and the left front corner portion of the tray in terms of the inward movement of the tray, when the electrical contact on the main assembly side is in contact with the intermediary electrical contact.

FIG. 9D shows the inward end portion of the left section 35*d* of the frame of the tray 35 when the tray 35 is in the image formation position, into which the tray 35 was lowered by the closing of the door 31. When the tray 35 is in this position, the electrical contact 75 (springy electrical contact) is in contact with the electrically conductive common member 78, which was moved down to the electrical contact 75; there is electrical connection between the two electrical contacts 75 and 78.

That is, the contact between the electrically conductive common member 78 and electrical contact 75 occurs while the tray 35 is moved down into the image formation position after being linearly and horizontally moved into the apparatus main assembly A from outside the apparatus main assembly A.

As the door 31 is opened when the tray 35 is in the position shown in FIG. 9D, the tray 35 is moved diagonally upward from the position shown in FIG. 9D. This diagonally upward movement of the tray 35 moves the electrically conductive common member 78 upward, causing the electrically conductive common member 78 to separate from the electrical contact 75, and therefore, breaking the electrical connection between the electrical contact 75 and electrically conductive common member 78.

In the case of the above described structural arrangement in this embodiment, the electrical contacts 75, that is, the electrical contacts of the apparatus main assembly, are solidly attached to the apparatus main assembly A, and the electrical connection between the electrical contacts 75 and the electrically conductive common member 78, that is, the electrical contact on the tray 35, is made by the diagonally downward movement of the tray 35. However, the above described structural arrangement is not intended to limit the present invention in scope. That is, the present invention is also compatible with a structural arrangement which does not move the tray 35 downward. For example, the present invention is effectively applicable to an image forming apparatus structured so that the electrical contacts 75 are placed in contact with the electrically conductive common member 78 by being moved by the movement of members, such as the tray holding members 34L and 34R, which are moved by the movement of the door 31.

As for the electrical disconnection between the electrical contacts 75 and electrically conductive common member 78, it is achieved by moving the tray 35 diagonally upward from the image formation positions (FIGS. 9C and 9D). In this case, the electrically conductive common member 78, that is, the electrical contact on the tray 35, comes into contact with the ground contact 79 (grounding plate, discharging member, or the like), which is an electrically conductive member connected to the apparatus main assembly A before the tray 35 reaches its highest level (FIG. 9B). Therefore, the electric charge having accumulated in the electrically conductive common member 78 is released to the ground contact 79. That is, while the tray 35 is moved, the ground contact 79 comes into contact with the electrically conductive common member 78, that is, the electrical contact on the tray 35, discharging the electric charge having accumulated in the electrical contacts of the cartridges. Designated by a referential number 82 is the portion of the apparatus main assembly A, to which the ground contact 79 is attached.

The ground contact 79 is electrically connected to the apparatus main assembly A to ground the electrically conductive common member 78, and is positioned next to the path of tray 35.

Regarding the contact between the electrically conductive common member 78 and electrical contact 75, and the contact between the electrically conductive common member 78 and ground contact 79, the electrical contact 75 comes into contact with the bottom side of the electrically conductive common member 78, whereas the ground contact 79 comes into contact with the top side of the electrically conductive common member 78.

The contact between the electrically conductive common member 78 and ground contact 79 occurs while the tray 35 is moved diagonally upward from its image formation position, whereas the separation of the electrically conductive common member 78 from the ground contact 79 occurs as the tray 35 is moved outward of the apparatus main assembly A.

Also regarding the contact between the electrically conductive common member 78 and electrical contact 75, and the contact between the electrically conductive common member 78 and ground contact 79, the leading end of the electrically conductive common member 78, in terms of the moving direction of the tray 35, comes into contact with the electrical contact 75 and ground contact 79 as the tray 35 is moved inward of the apparatus main assembly A from outside the apparatus main assembly A.

Also in the case of the above described structural arrangement in this embodiment, the ground contact 79 is solidly attached to the apparatus main assembly A, and the electrical connection between the ground contact 79 and the electrically conductive common member 78, that is, the electrical contact on the tray 35, is made by the diagonally upward movement of the tray 35. However, the above described structural arrangement is not intended to limit the present invention in scope. That is, the present invention is also compatible with a structural arrangement which does not move the tray 35 upward. For example, the present invention is effectively applicable to an image forming apparatus structured so that the ground contact 79 is placed in contact with the electrically conductive common member 78 by being moved by the movement of members, such as the tray holding members 34L and 34R, which are moved by the movement of the door 31.

As for the timing with which the ground contact 79 is disconnected from the electrically conductive common member 78, the ground contact 79 is disconnected from the electrically conductive common member 78 after the high voltage applied to the electrical contacts 75 during image formation is cut off. As for the means for cutting off the high voltage, a structural arrangement may be made so that the electrical contact 75 can be physically separated from the electrically conductive common member 78, or the apparatus main assembly A may be provided with an electrical switch interlocked with the door 31, so that the high voltage is cut off by the opening movement of the door 31.

The electrically conductive common member 78 is formed of a piece of metallic plate which is thick enough for the electrically conductive common member 78 to serve not only as an electrical contact, but also, as a member for reinforcing the tray 35. Further, the electrically conductive common member 78 is given a U-shaped cross section so that it can serve as a member for reinforcing the tray 35, in addition to functioning as an electrical contact. That is, the electrically conductive common member 78, that is, the member formed of the abovementioned material and shaped as described above, is effective to reinforce the tray 35, which is provided with a substantial number of holes for accommodating a substantial number of electrical contacts.

The employment of the electrically conductive common member 78 for supplying multiple cartridges with electric power can reduce the number of components necessary for applying biases to the multiple cartridges, provided that the multiple cartridges are the same in the bias applied thereto. Therefore, it can achieve cost reduction. It also can ensure, without increasing component count, that electrical connection is made between the electrical contacts of each cartridge and those of the apparatus main assembly A.

As described above, according to the present invention, multiple process cartridges are mounted in a movable member (tray) so that the cartridges can be replaced from the front side of an image forming apparatus. Further, the movable member is provided with the electrically conductive common member 78, and the electrical contacts of the movable tray are organized so that those which are the same in the potential level of the electric power transmitted through them receive electric power (bias) from the apparatus main assembly A through a single point (of electrical contact of apparatus main assembly A). Therefore, an electrophotographic color image forming apparatus can be reduced in component count. Further, the movable member (tray) can be increased in the amount of strength necessary for the movable member to withstand the force to which it is subjected as it is moved outward or inward of the apparatus main assembly A. Thus, it is possible to provide an image forming apparatus having an easily movable cartridge holding member (tray) for making it easier to replace the cartridges.

Also according to the present invention, the movable member is moved upward or downward by the member of the apparatus main assembly, which exposes or covers the opening of the apparatus main assembly, which is for the movable member. Therefore, a cartridge or cartridges can be replaced by a user through an easily predictable operational sequence.

Further, multiple sets of electrical contacts are horizontally aligned so that an electrical contact in one set is positioned at the same level as the corresponding electrical contacts in the other sets. Therefore, the space which is required to accommodate the electrical contacts in terms of the vertical direction is substantially smaller than that which the prior art requires. In other words, the present invention can substantially reduce in size the main assembly of an image forming apparatus employing a movable cartridge holding member.

Also according the present invention, the tray 35 is provided with the electrically conductive common member 78 for distributing electric power to the cartridges in the tray 35, and the number of electrical junctions between the electrically conductive common member 78 and the electrical contacts of the cartridges, is greater than the number of electrical junctions between the electrically conductive common member 78 and electrical contact 75. Therefore, the number of the components necessary to apply biases to the multiple cartridges in the tray 35 is significantly smaller than that in accordance with the prior art, provided that the multiple cartridges are the same in the biases applied thereto. Therefore, the present invention can achieve cost reduction. In other words, the present invention can ensure, without increasing component count, that the electrical contacts of the cartridges are connected to the electrical contacts of the apparatus main assembly.

The contact between the electrically conductive common member 78 and electrical contact 75 occurs while the tray 35, which is a movable member, is moved diagonally downward into the image formation position after being linearly moved into the apparatus main assembly A from outside the apparatus main assembly A. Therefore, when the tray 35 is horizontally moved, the electrically conductive common member 78 and electrical contact 75 do not rub against each other; the two are prevented from unnecessary rubbing against each other. Further, the mechanism for moving the electrical contact 75 between the position in which the electrical contact 75 is in contact with the electrically conductive common member 78, and the position in which it is not in contact with the electrically conductive common member 78, is unnecessary.

Incidentally, the ground contact 79 has to be away from the electrically conductive common member 78 while the image forming apparatus is forming an image. According to the present invention, however, the ground contact 79, which is placed in contact with the apparatus main assembly A to ground the electrically conductive common member 78, is positioned next to the path of the tray 35. Therefore, the mechanism for placing the ground contact 79 in contact with the electrically conductive common member 78, or separating the ground contact 79 from the electrically conductive common member 78 is unnecessary. In other words, the present invention can simplify in structure an image forming apparatus having a movable cartridge holding member.

If the ground contact 79 is in the path of the tray 35, the ground contact 79 is repeatedly rubbed by the electrically conductive common member 78. In order to prevent this problem, a mechanism is necessary for keeping the ground contact 79 outside the path of the tray 35 when the electrically conductive common member 78 does not need to be grounded. According to the present invention, however, an image forming apparatus having a movable cartridge holding member is structured so that the contact between the electrically conductive common member 78 and grounding contact 79 occurs while the tray 35 is moved diagonally upward from the image formation positions. Thus, not only can the present invention solve the problem described above, but also, it can simplify in structure an image forming apparatus having a cartridge holding movable member.

Further, in the preferred embodiment described above, the processing means which receives electric power from the apparatus main assembly A through the electrical contact 75, electrically conductive common member 78, and electrical contacts 72 is the charge roller for charging the electrophotographic photosensitive drum. To elaborate, the development biases applied to the development bias supplying rollers of the cartridge PY, PM, PC, and PK, one for one, must be set to be different in value because of the difference among the developers in the cartridges. However, the biases applied to the charge rollers of the cartridges PY, PM, PC, and PK are to be set by the relationship between the drum and charge roller, and therefore, may be the same in value.

Further, the electrically conductive common member 78 is formed of electrically conductive metallic plate, and the tray 35 is formed of an electrically nonconductive resin. The electrically conductive common member 78 is attached to one end of the tray 35 in terms of the direction perpendicular to the moving direction of the tray 35. It is an ordinary practice to place interfacial electrical contacts on one side of the tray 35, because such a practice requires only a single substrate. However, this practice tends to significantly weaken the tray on the side having the electrical contacts, because the tray has to accommodate multiple electrical contacts for each cartridge. Therefore, forming the electrically conductive common member 78 of metallic plate is effective to reinforce the portion of the tray 35, which is to accommodate the multiple electrical contacts. In other words, in this embodiment, the electrically conductive common member 78, that is, a piece of metallic plate, doubles as a member for reinforcing the tray 35. That is, the piece of metallic plate prevents the tray 35 from unexpectedly deforming.

Further, the metallic plate 78 is given a U-shaped cross section, being thereby stiffened, and is attached to the tray 35 in a manner to straddle the top edge of the abovementioned section of the tray 35. Therefore, the tray 35 is further increased in strength.

Further, regarding the contact between the electrically conductive common member 78 and electrical contact 75, and the contact between the electrically conductive common member 78 and ground contact 79, the leading end of the electrically conductive common member 78, in terms of the inward movement of the tray 35 relative to the apparatus main assembly, comes into contact with the electrical contact 75 and ground contact 79 as the tray 35 is moved inward of the apparatus main assembly A from outside the apparatus main assembly A. Therefore, it does not occur that the electrically conductive common member 78 continuously rubs against the electrical contact 75 during the movement of the tray 35. The longer or more frequent the rubbing of the electrically conductive common member 78 against the electrical contact 75, the greater the amount by which they shave each other. In this embodiment, therefore, the amount by which they shave each other is reduced by making the two electrical contacts 78 and 75 make contact at the end of the inward movement of the tray 35. Further, the electrically conductive common member 78 is grounded before the tray 35 is pulled out of the apparatus main assembly A (before the tray 35 is touched by a user). Further, the electrically conductive common member 78 comes into contact with the ground contact 79 by its top side. That is, the electric charge which the electrically conductive common member 78 has is removed by the diagonally upward movement of the tray 35, which is caused by the opening movement of the door 31. Therefore, more latitude is afforded regarding the positioning of the ground contact 79. Further, the electrically conductive common member 78 is placed in contact with the electrical contact 75 by the diagonally downward movement of the tray 35, that is, the tray movement for moving the cartridges into their image formation positions, which is caused by the closing movement of the door 31. Therefore, more latitude is afforded regarding the positioning of the electrical contact 75.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 122493/2007 filed May 7, 2007 which is hereby incorporated by reference.

What is claimed is:

1. A color electrophotographic image forming apparatus including a main assembly to which process cartridges each including an electrophotographic photosensitive drum and process means actable on said electrophotographic photosensitive drum are detachably mountable, said color electrophotographic image forming apparatus comprising:

a movable member having a plurality of supporting portions for supporting a plurality of said process cartridges in juxtaposition, said movable member being movable between a set position inside said main assembly of the apparatus and a position outside said main assembly of the apparatus in a direction crossing a longitudinal direction of said electrophotographic photosensitive drum in a state in which a plurality of said process cartridges are supported on said plurality of supporting portions;

a common electroconductive member which is common to said process cartridges and which is extended on said movable member in a direction of movement of said movable member, said common electroconductive member having a length enough to contact to longitudinal ends of said process cartridges which are supported in juxtaposition with each other on said plurality of supporting portions;

an electrical contact portion which is provided, for each of said plurality of supporting portions, on said movable member and which is electrically connected with said common electroconductive member, said electrical contact portion being electrically connectable with a cartridge electrical contact provided on each of said process cartridges;

a main assembly electrical contact electrically connectable with said common electroconductive member to supply electric power to said common electroconductive member from said main assembly of the apparatus at least when said movable member is placed at the set position;

wherein the electric power can be supplied from the main assembly of the apparatus to the process cartridges supported on respective supporting portions of said movable member placed at the set position through said main assembly electrical contact, said common electroconductive member and respective electrical contact portions.

2. An apparatus according to claim 1, wherein a contact between said common electroconductive member and said main assembly electrical contact is established while said movable member lowers toward the set position after said movable member is moved from the outside into said main assembly of the apparatus linearly.

3. An apparatus according to claim 1 or 2, further comprising a grounding contact, electrically connected with said main assembly and disposed along a movement path of said movable member, for electrically grounding said common electroconductive member.

4. An apparatus according to claim 3, wherein a contact between said common electroconductive member and said grounding contact is established while said movable member rises from the set position.

5. An apparatus according to any one of claims 1 and 2, wherein said main assembly electrical contact, said common electroconductive member and said electrical contact portions are capable of supplying the electric power to a charging roller for electrically charging said electrophotographic photosensitive drum.

6. An apparatus according to any one of claims 1 and 2, wherein said common electroconductive member includes an electroconductive metal plate, and said movable member is made of insulative resin material, and wherein said common electroconductive member is disposed at one end with respect to a direction crossing the movement direction of said movable member.

7. An apparatus according to any one of claims 1 and 2, wherein said common electroconductive member includes an electroconductive metal plate and wherein said metal plate extends on a top edge portion of one side of said movable member along the moving direction.

8. An apparatus according to claim 7, wherein said common electroconductive member is connectable with said main assembly electrical contact and with grounding contact at a leading side of said common electroconductive member with respect to the movement direction of said movable member into said main assembly of the apparatus.

9. An apparatus according to claim 8, wherein said common electroconductive member is connectable to said main assembly electrical contact at a lower position of said common electroconductive member, and wherein said common electroconductive member is connectable with said grounding contact at an upper position of said common electroconductive member.

* * * * *